US011098492B2

(12) United States Patent
Machida et al.

(10) Patent No.: US 11,098,492 B2
(45) Date of Patent: Aug. 24, 2021

(54) REBAR TYING TOOL

(71) Applicant: MAKITA CORPORATION, Anjo (JP)

(72) Inventors: Yoshitaka Machida, Anjo (JP); Tadasuke Matsuno, Anjo (JP)

(73) Assignee: MAKITA CORPORATION, Anjo (JP)

( * ) Notice: Subject to any disclaimer, the term of this patent is extended or adjusted under 35 U.S.C. 154(b) by 0 days.

(21) Appl. No.: 16/864,326

(22) Filed: May 1, 2020

(65) Prior Publication Data

US 2020/0270881 A1 Aug. 27, 2020

Related U.S. Application Data

(63) Continuation of application No. 15/593,446, filed on May 12, 2017, now Pat. No. 10,655,348.

(30) Foreign Application Priority Data

May 20, 2016 (JP) ..... 2016-101717

(51) Int. Cl.
*E04G 21/12* (2006.01)
*B21F 15/04* (2006.01)

(52) U.S. Cl.
CPC ..... *E04G 21/122* (2013.01); *B21F 15/04* (2013.01); *E04G 21/123* (2013.01)

(58) Field of Classification Search
CPC ..... E04G 21/122; E04G 21/123; B21F 15/02; B21F 15/04; B25B 25/00; B65B 13/025;
(Continued)

(56) References Cited

U.S. PATENT DOCUMENTS 5,279,336 A * 1/1994 Kusakari ..... E04G 21/123 140/57
5,678,613 A * 10/1997 Murayama ..... E04G 21/123 140/119

(Continued)

FOREIGN PATENT DOCUMENTS

CN 101353088 A * 1/2009 ..... B65B 13/025
CN 101353088 A 1/2009

(Continued)

OTHER PUBLICATIONS

Translation: Kusakari, JP-2008291642A, Translated Nov. 12, 2020 (Year: 2008).*

(Continued)

*Primary Examiner* — Debra M Sullivan
*Assistant Examiner* — Matthew Kresse
(74) *Attorney, Agent, or Firm* — Oliff PLC

(57) ABSTRACT

A rebar tying tool configured to tie plural rebars using a wire is disclosed herein. The rebar tying tool may include a reel supporting mechanism configured to switch between a first state of detachably supporting a reel on which the wire is wound and a second state of undetachably supporting the reel; a wire feeding mechanism configured to feed the wire from the reel; and an openable cover that at least partially covers at least one of the reel supporting mechanism and the wire feeding mechanism. The reel supporting mechanism may switch from the first state to the second state by a user operation of closing the cover, and/or may switch from the second state to the first state by a user operation of opening the cover.

10 Claims, 16 Drawing Sheets

(58) Field of Classification Search
CPC ..... B65B 13/027; B65B 13/04; B65B 13/08; B65B 13/14
See application file for complete search history.

(56) References Cited

U.S. PATENT DOCUMENTS

| | | | | |
|---|---|---|---|---|
| 9,004,114 | B2 * | 4/2015 | Kasahara | E04G 21/122 140/93.6 |
| 9,192,979 | B2 * | 11/2015 | Itagaki | B65B 13/22 |
| 2009/0283167 | A1 | 11/2009 | Nakagawa et al. | |
| 2009/0283169 | A1 | 11/2009 | Itagaki et al. | |
| 2016/0108632 | A1 | 4/2016 | Lu | |

FOREIGN PATENT DOCUMENTS

| | | | | |
|---|---|---|---|---|
| JP | H05-006015 | U | | 1/1993 |
| JP | 2008291642 | A | * | 7/2008 |
| JP | 2008-291642 | A | | 12/2008 |
| JP | 2009-275488 | A | | 11/2009 |

OTHER PUBLICATIONS

Cai—CN101353088A—Translated Dec. 2020 (Year: 2009).*
Jul. 11, 2019 Office Action issued in U.S. Appl. No. 15/593,446.
Nov. 25, 2019 U.S. Office Action issued U.S. Appl. No. 15/593,446.
Feb. 28, 2020 U.S. Notice of Allowance issued U.S. Appl. No. 15/593,446.
Mar. 3, 2020 Office Action issued in Japanese Patent Application No. 2016-101717.
U.S. Appl. No. 15/593,446, filed May 12, 2017 in the name of Machida et al.

* cited by examiner

REBAR TYING TOOL

CROSS-REFERENCE TO RELATED APPLICATION

This application is a continuation application of U.S. patent application Ser. No. 15/593,446, filed on May 12, 2017, which claims priority from Japanese Patent Application No. 2016-101717, filed May 20, 2016. The disclosures of the foregoing applications are hereby incorporated by reference in their entirety.

TECHNICAL FIELD

A technique disclosed herein relates to a rebar tying tool.

BACKGROUND

Japanese Patent Application Publication No. 2009-275488 discloses a rebar tying tool that ties plural rebars using a wire. The rebar tying tool is provided with a reel supporting mechanism capable of switching between a first state of detachably supporting a reel on which the wire is wound and a second state of undetachably supporting the reel, a wire feeding mechanism that feeds the wire from the reel, an openable cover that partially covers the wire feeding mechanism, a biasing mechanism that applies biasing force to switch the reel supporting mechanism from the second state to the first state, and a lock mechanism that prohibits the reel supporting mechanism to switch from the second state to the first state.

SUMMARY

In the rebar tying tool of Japanese Patent Application Publication No. 2009-275488, when a user is to set the reel, the user is required to set the reel in the reel supporting mechanism in the first state, switch the reel supporting mechanism from the first state to the second state against the biasing force from the biasing mechanism, lock the reel supporting mechanism by the lock mechanism, set the wire extending from the reel to the wire feeding mechanism, and then close the cover. These operations create complication in user's work to set the reel.

Further, in the rebar tying tool of Japanese Patent Application Publication No. 2009-275488, when the user is to remove the reel, the user is required to open the cover, detach the wire extending from the reel from the wire feeding mechanism, release the lock on the reel supporting mechanism by the lock mechanism, and remove the reel from the reel supporting mechanism in the first state. These operations create complication in user's work to remove the reel.

The disclosure herein provides a technique that brings improvement to work performance of setting and removing a reel in a rebar tying tool.

A rebar tying tool configured to tie plural rebars using a wire is disclosed herein. The rebar tying tool may comprise a reel supporting mechanism configured to switch between a first state of detachably supporting a reel on which the wire is wound and a second state of undetachably supporting the reel; a wire feeding mechanism configured to feed the wire from the reel; and an openable cover that at least partially covers at least one of the reel supporting mechanism and the wire feeding mechanism. In the rebar tying tool, the reel supporting mechanism may switch from the first state to the second state by a user operation of closing the cover.

In the above rebar tying tool, when a user is to set the reel, the user simply needs to set the reel in the reel supporting mechanism in the first state, set the wire extending from the reel to the wire feeding mechanism, and close the cover. That is, in the above rebar tying tool, the reel supporting mechanism automatically switches from the first state to the second state when the user sets the reel to the reel supporting mechanism in the first state and closes the cover, and the reel is thereby set in the rebar tying tool. According to the above rebar tying tool, the work performance of setting the reel can further be improved.

Another rebar tying tool configured to tie plural rebars using a wire is also disclosed herein. The rebar tying tool may comprise a reel supporting mechanism configured to switch between a first state of detachably supporting a reel on which the wire is wound and a second state of undetachably supporting the reel; a wire feeding mechanism configured to feed the wire from the reel; and an openable cover that at least partially covers at least one of the reel supporting mechanism and the wire feeding mechanism. In the rebar tying tool, the reel supporting mechanism may switch from the second state to the first state by a user operation of opening the cover.

In the above rebar tying tool, when the user is to remove the reel, the user simply needs to open the cover, detach the wire extending from the reel from the wire feeding mechanism, and remove the reel from the reel supporting mechanism in the first state. That is, in the above rebar tying tool, the reel supporting mechanism automatically switches from the second state to the first state when the user opens the cover, and the reel can thereby be removed from the reel supporting mechanism. According to the above rebar tying tool, the work performance of removing the reel can further be improved.

Another rebar tying tool configured to tie plural rebars using a wire is also disclosed herein. The rebar tying tool may comprise a reel supporting mechanism configured to support a reel on which the wire is wound and an openable cover that at least partially covers the reel supporting mechanism. In the rebar tying tool, an upper portion of the reel may be at least partially protruding externally when the cover is open and the reel supporting mechanism supports the reel.

In the above rebar tying tool, the upper portion of the reel protrudes externally upon when the user removes the reel from the reel supporting mechanism, thus the reel can easily be gripped.

DETAILED DESCRIPTION

Figure 1:
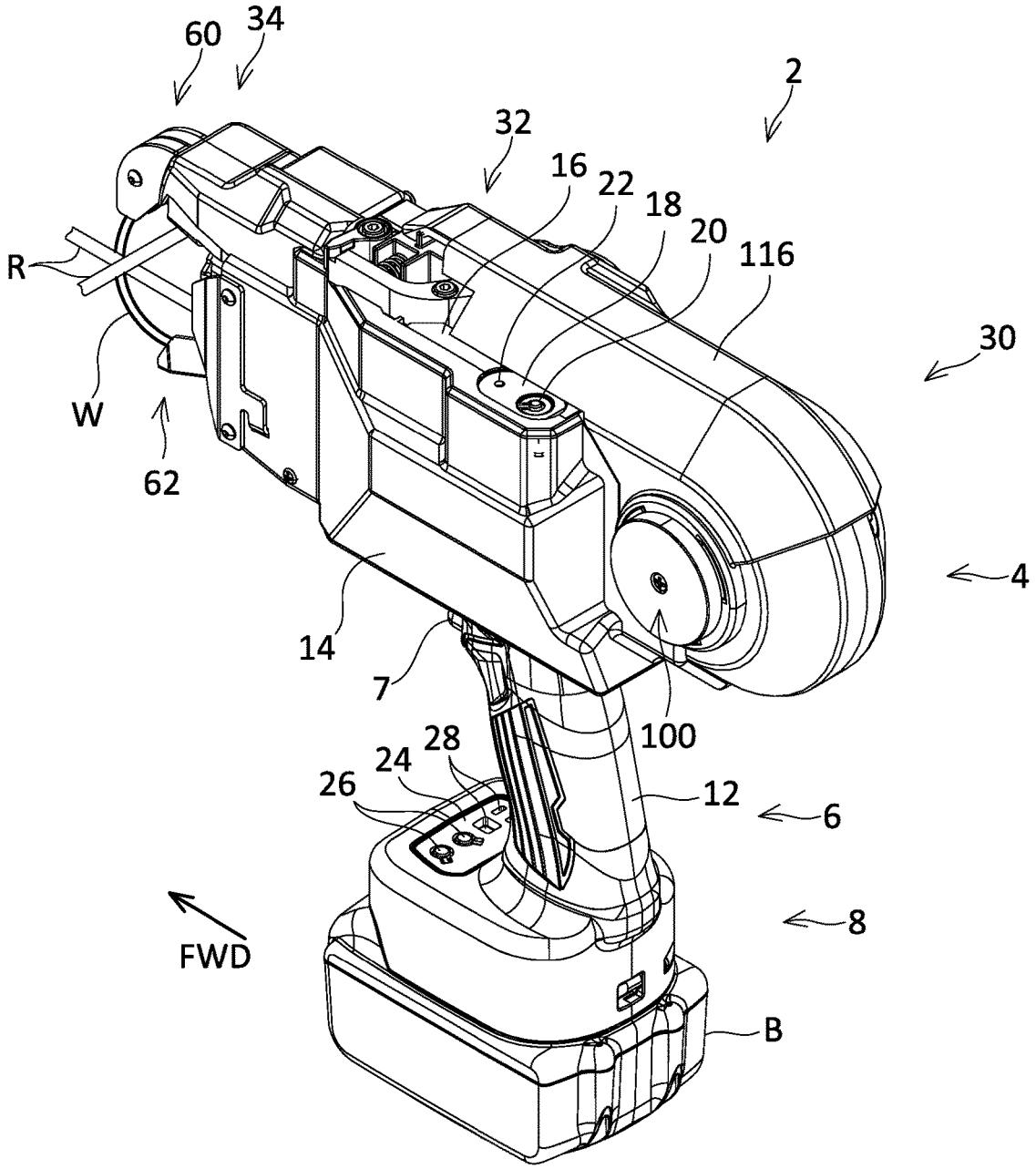
FIG. 1 is a perspective view that sees a rebar tying tool 2 according to an embodiment from an upper-left rear side.

In one or more aspects of the present teachings, in a rebar tying tool, a reel may comprise a bearing groove, a reel supporting mechanism may comprise a reel loading chamber in which the reel is to be set; and a bearing member configured to engage with the bearing groove of the reel, and configured to move between a first position where the bearing member does not interfere with the reel upon setting the reel in the reel loading chamber and upon removing the reel from the reel loading chamber, and a second position where the bearing member engages with the bearing groove of the reel, and the bearing member may move from the first position to the second position by the user operation of closing a cover.

According to the above configuration, the reel supporting mechanism configured to switch between a first state of detachably supporting the reel and a second state of undetachably supporting the reel can be realized by a simple configuration.

In the above-mentioned rebar tying tool, a distal end of the bearing member may be tapered.

According to the above configuration, a tapered shape at the distal end of the bearing member serves as a guide upon when the bearing member moves from the first position to the second position, and thereby positioning of the reel and the bearing member can be performed. Even if the reel is not positioned appropriately when the reel supporting mechanism is supporting the reel in the first state, the bearing member can surely be engaged with the bearing groove of the reel by switching the reel supporting mechanism from the first state to the second state.

In the above-mentioned rebar tying tool, the cover and the bearing member may operate interconnectedly via a cam mechanism.

According to the above configuration, the cover and the bearing member operate interconnectedly by a mechanical interconnection, thus malfunction can be suppressed as compared to a case where the cover and the bearing member operate interconnectedly via an electric circuit.

In the above-mentioned rebar tying tool, the cover may at least partially cover a top portion of at least one of the reel supporting mechanism and the wire feeding mechanism.

According to the above configuration, the top portion(s) of the reel supporting mechanism and/or the wire feeding mechanism can be opened in a state where the cover is open, so the user who is holding the rebar tying tool can easily see inside(s) of the reel supporting mechanism and/or the wire feeding mechanism from above.

In the above-mentioned rebar tying tool, the cover may pivot to open and to close.

According to the above configuration, a mechanism for opening and closing the cover can be simplified.

In the above-mentioned rebar tying tool, a pivot axis of the cover may substantially match a rotating axis of the reel supported by the reel supporting mechanism in the second state.

According to the above configuration, a size of the rebar tying tool when the cover is open can be made smaller as compared to a case where the pivot axis of the cover is arranged on a surface of the rebar tying tool.

In one or more aspects of the present teachings, in a rebar tying tool, a reel may comprise a bearing groove, a reel supporting mechanism may comprise a reel loading chamber in which the reel is to be set; and a bearing member configured to engage with the bearing groove of the reel, and configured to move between a first position where the bearing member does not interfere with the reel upon setting the reel in the reel loading chamber and upon removing the reel from the reel loading chamber, and a second position where the bearing member engages with the bearing groove of the reel, and the bearing member may move from the second position to the first position by a user operation of opening a cover.

According to the above configuration, the reel supporting mechanism configured to switch between the first state of detachably supporting the reel and the second state of undetachably supporting the reel can be realized by a simple configuration.

In the above-mentioned rebar tying tool, the cover and the bearing member may operate interconnectedly via a cam mechanism.

According to the above configuration, the cover and the bearing member operate interconnectedly by a mechanical interconnection, thus malfunction can be suppressed as compared to the case where the cover and the bearing member operate interconnectedly via an electric circuit.

In the above-mentioned rebar tying tool, an upper portion of the reel may be at least partially protruding externally when the cover is open and the reel supporting mechanism is in the first state.

According to the above configuration, the upper portion of the reel protrudes to outside upon when the user removes the reel from the reel supporting mechanism, thus the reel can easily be gripped.

In the above-mentioned rebar tying tool, the cover may at least partially cover a top portion of at least one of the reel supporting mechanism and the wire feeding mechanism.

According to the above configuration, the top portion(s) of the reel supporting mechanism and/or the wire feeding mechanism can be opened in the state where the cover is open, so the user who is holding the rebar tying tool can easily see inside(s) of the reel supporting mechanism and/or the wire feeding mechanism from above.

In the above-mentioned rebar tying tool, the cover may pivot to open and to close.

According to the above configuration, the mechanism for opening and closing the cover can be simplified.

In the above-mentioned rebar tying tool, a pivot axis of the cover may substantially match a rotating axis of the reel supported by the reel supporting mechanism in the second state.

According to the above configuration, the size of the rebar tying tool when the cover is open can be made smaller as compared to the case where the pivot axis of the cover is arranged on the surface of the rebar tying tool.

Embodiment

A rebar tying tool 2 according to an embodiment will be described with reference to the drawings. The rebar tying tool 2 shown in FIG. 1 is a power tool for tying plural rebars R by a wire W.

Figure 2:
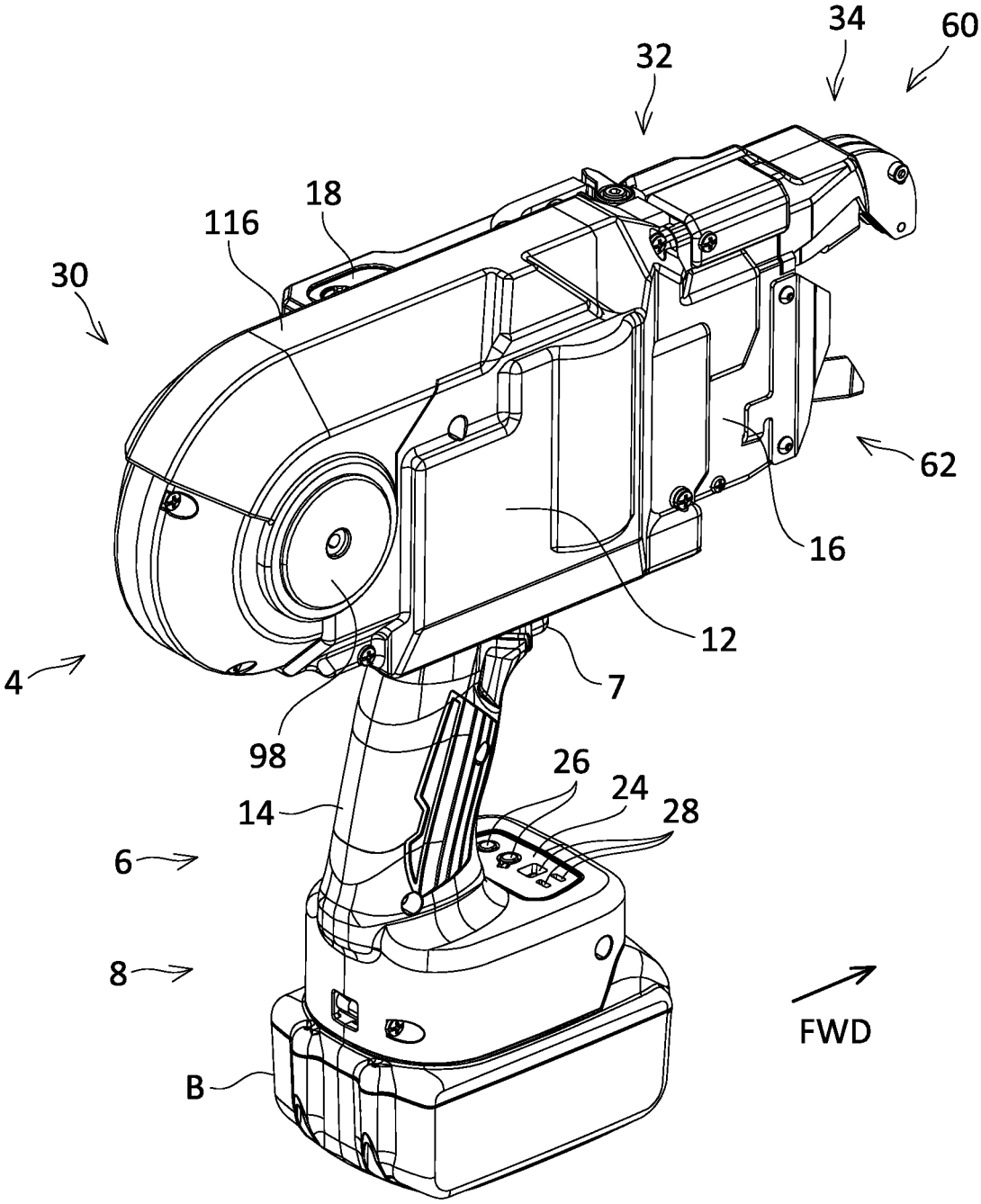
FIG. 2 is a perspective view that sees the rebar tying tool 2 according to the embodiment from an upper-right rear side.

As shown in FIGS. 1 and 2, the rebar tying tool 2 comprises a tying tool body 4, a grip 6 provided below the tying tool body 4, and a battery interface 8 provided below the grip 6. A trigger 7 is provided at a front upper portion of the grip 6. A battery B is detachably attached below the battery interface 8. The tying tool body 4, the grip 6, and the battery interface 8 are integrated by coupling a right outer housing 12 and a left outer housing 14. Further, the tying tool body 4 is provided with an inner housing 16 between the right outer housing 12 and the left outer housing 14. The right outer housing 12, the left outer housing 14, and the inner housing 16 can each be termed a housing plate. A first operation display 18 is provided on an upper surface of the tying tool body 4. The first operation display 18 is provided with a main switch 20 for switching power of the rebar tying tool 2 between on and off, and a main power LED 22 for displaying an on/off state of the power of the rebar tying tool 2. A second operation display 24 is provided on a front upper surface of the battery interface 8. The second operation display 24 is provided with setting buttons 26 for setting a feed amount of the wire W and twisting intensity for the wire W, and a display 28 for displaying contents set by the setting buttons 26. The battery B, the trigger 7, the first operation display 18, and the second operation display 24 are connected to a control board 134 to be described later.

Figure 3:
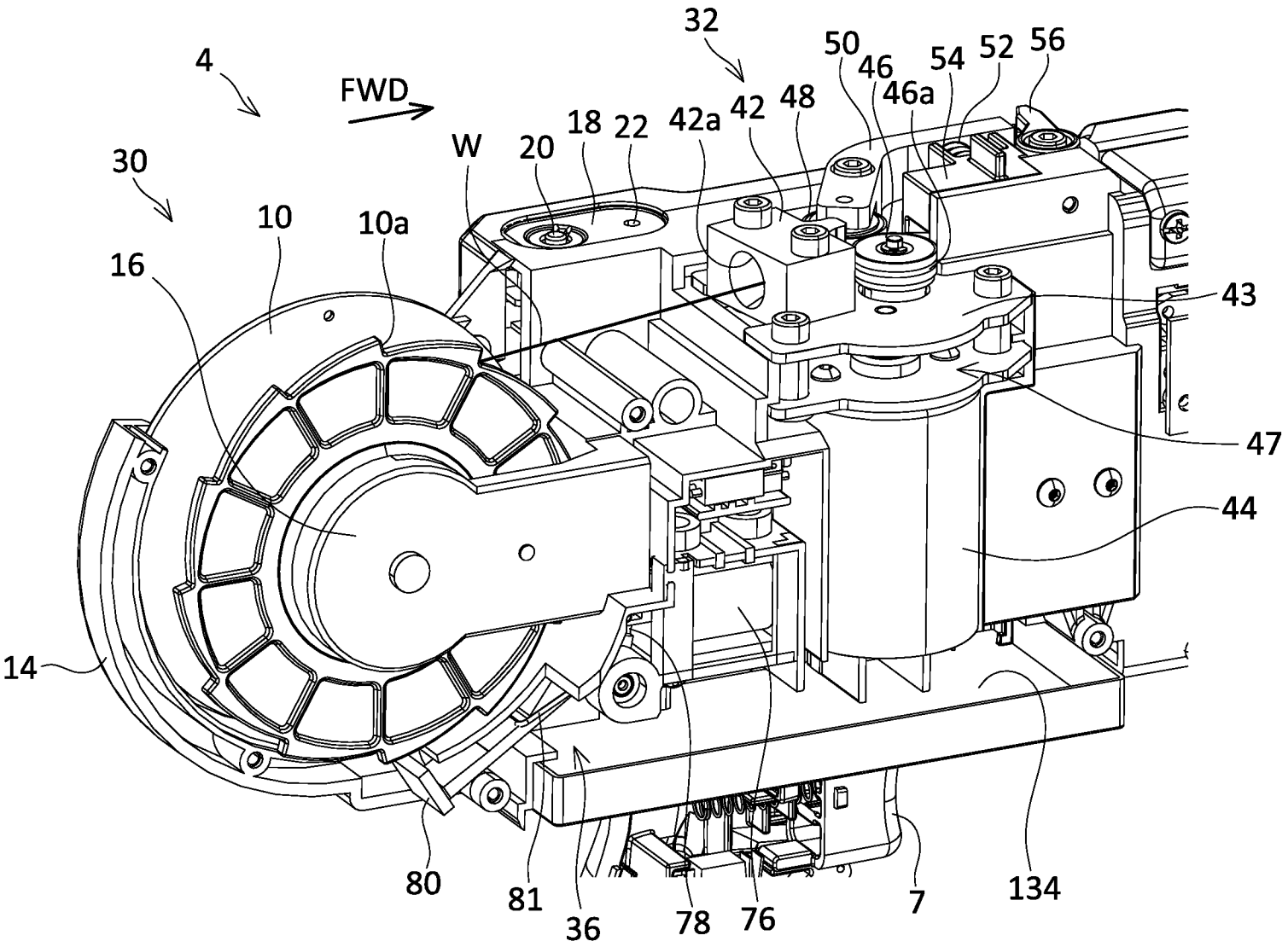
FIG. 3 is a perspective view that sees an internal structure of a tying tool body 4 of the rebar tying tool 2 according to the embodiment from the upper-right rear side.
Figure 4:
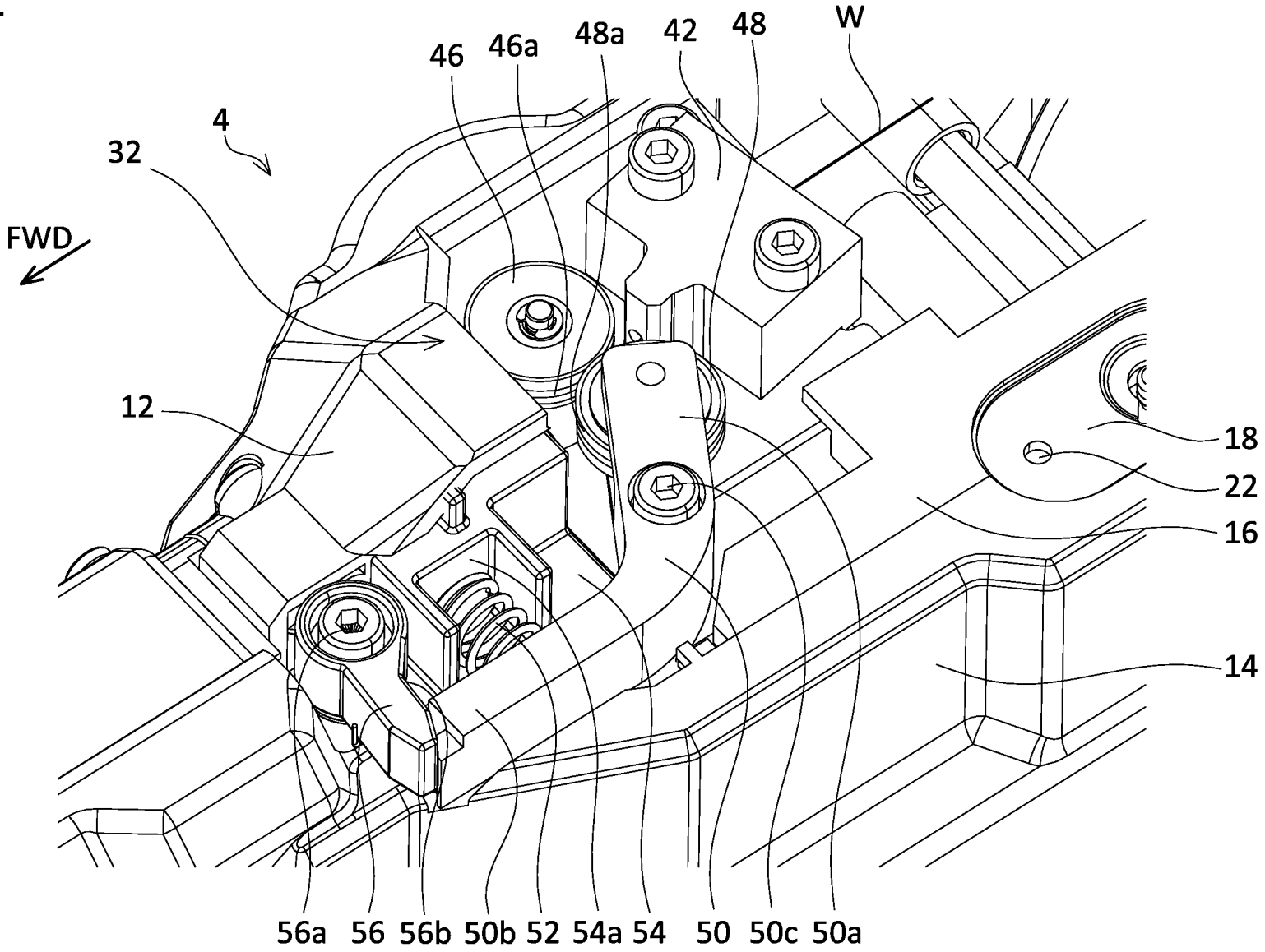
FIG. 4 is a perspective view that sees a wire feeding mechanism 32 of the rebar tying tool 2 according to the embodiment from an upper-left front side.
Figure 5:
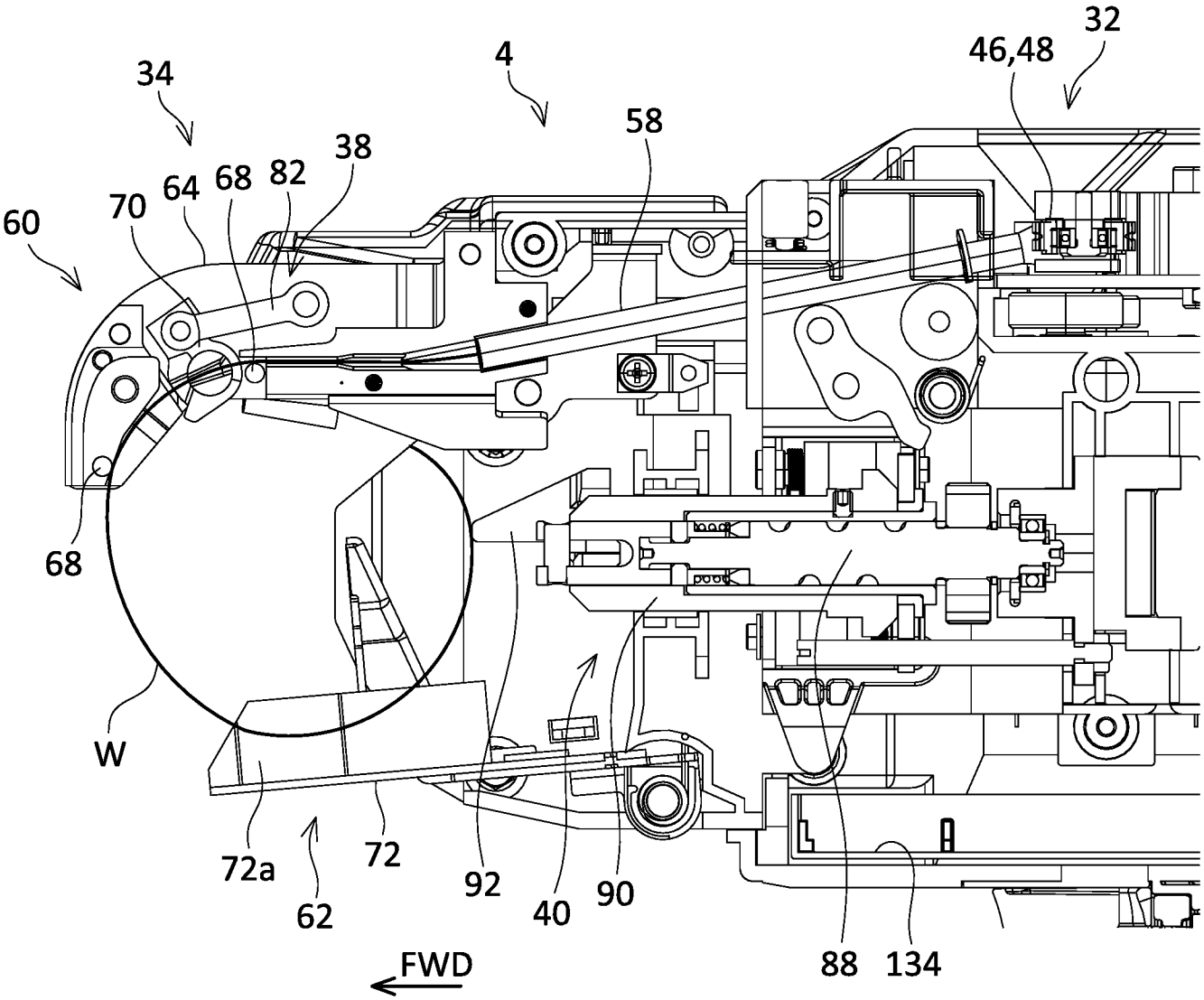
FIG. 5 is a cross sectional view that sees the internal structure of the tying tool body 4 of the rebar tying tool 2 according to the embodiment from a left side.
Figure 6:
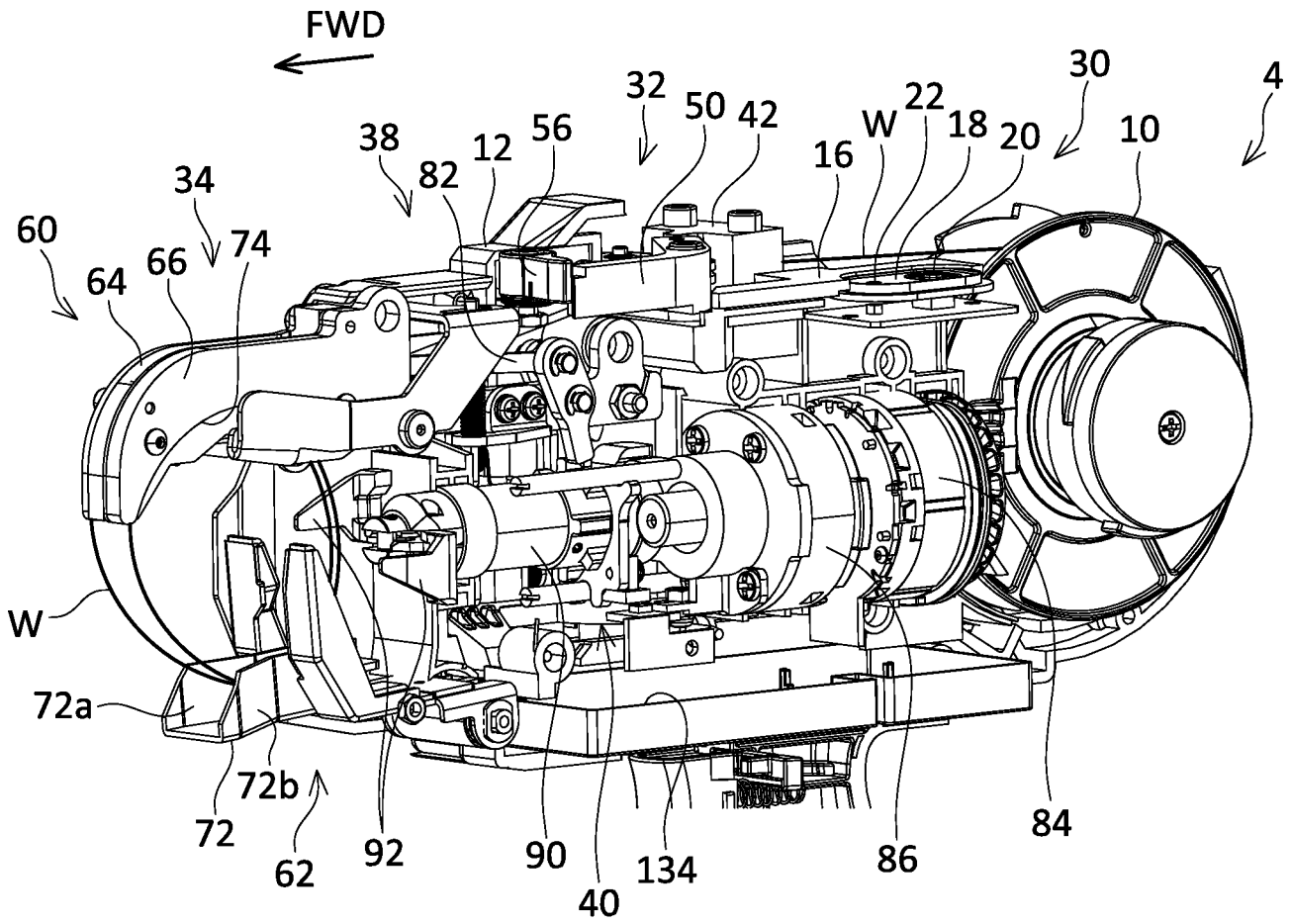
FIG. 6 is a perspective view that sees the internal structure of the tying tool body 4 of the rebar tying tool 2 according to the embodiment from a left front side.

As shown in FIGS. 3 to 6, the tying tool body 4 primarily comprises a reel supporting mechanism 30 (see FIG. 3), a wire feeding mechanism 32 (see FIGS. 3 and 4), a wire guide mechanism 34 (see FIGS. 5 and 6), a braking mechanism 36 (see FIG. 3), a wire cutting mechanism 38 (see FIG. 5), a wire twisting mechanism 40 (see FIGS. 5 and 6), and the control board 134 (see FIGS. 3, 5, and 6). It should be noted that, for clearer depiction in the drawings, the right outer housing 12 and a cover 116 (details of which will be described later) are omitted in FIG. 3, the cover 116 is omitted in FIG. 4, and the left outer housing 14 and the cover 116 are omitted in FIG. 6. Further, in FIGS. 3 to 6, connection wires inside the rebar tying tool 2 are also omitted. The control board 134 is arranged at a central lower portion of the tying tool body 4 so as to traverse the inner housing 16. A part of the control board 134 is arranged on one side (right outer housing 12 side) as seen from the inner housing 16, and another part of the control board 134 is arranged on the other side (left outer housing 14 side) as seen from the inner housing 16.

The reel supporting mechanism 30 shown in FIG. 3 is configured to switch between a first state in which the reel supporting mechanism 30 detachably supports a reel 10 on which the wire W is wound, and a second state in which the reel supporting mechanism 30 undetachably supports the reel 10. Details of the reel supporting mechanism 30 will be described later.

The wire feeding mechanism 32 shown in FIGS. 3 and 4 is configured to feed out the wire W, which is supplied from the reel 10 supported by the reel supporting mechanism 30 in the second state (see FIG. 3), to the wire guide mechanism 34 (see FIGS. 5 and 6) located on a front side of the tying tool body 4. The wire feeding mechanism 32 comprises a guiding member 42, a base member 43, a feeding motor 44, a driving gear 46, a reduction mechanism 47, a driven gear 48, a releasing lever 50, a compression spring 52, a lever holder 54, and a lock lever 56. The guiding member 42 comprises a truncated cone-shaped through hole 42*a* having a wide rear end and a narrow front end. The guiding member 42 is fixed to the base member 43. The driving gear 46 and the driven gear 48 are arranged on a front side relative to the guiding member 42. The driving gear 46 is coupled to the feeding motor 44 via the reduction mechanism 47, and it rotates by being driven by the feeding motor 44. The feeding motor 44 is connected to the control board 134 via a connection wire that is not shown. The control board 134 can control an operation of the feeding motor 44. A V-shaped groove 46*a* that extends in a circumferential direction of the driving gear 46 at a center in its height direction is provided on a side surface of the driving gear 46. As shown in FIG. 4, the driven gear 48 is rotatably supported by a gear arm 50*a* of the releasing lever 50. A V-shaped groove 48*a* that extends in a circumferential direction of the driven gear 48 at a center in its height direction is provided on a side surface of the driven gear 48. The releasing lever 50 is a substantially L-shaped member provided with the gear arm 50*a* and an operation arm 50*b*. The releasing lever 50 is pivotally supported by the base member 43 via a pivot axis 50*c*. The operation arm 50*b* of the releasing lever 50 is coupled to a spring receiving portion 54*a* of the lever holder 54 via the compression spring 52. The lever holder 54 is fixed by being clamped between the inner housing 16 and the left outer housing 14. The compression spring 52 biases the operation arm 50*b* towards a direction separating away from the spring receiving portion 54*a*. Under a normal state, torque that causes the driven gear 48 to approach the driving gear 46 is applied to the releasing lever 50 by biasing force of the compression spring 52, and the driven gear 48 is thereby pressed against the driving gear 46. Due to this, teeth of the driven gear 48 on its side surface and teeth of the driving gear 46 on its side surface engage with each other, and the wire W is held between the V-shaped groove 46*a* of the driving gear 46 and the V-shaped groove 48*a* of the driven gear 48. When the feeding motor 44 rotates the driving gear 46 under such a state, the driven gear 48 rotates in an opposite direction to the rotation direction of the driving gear 46, and the wire W held by the driving gear 46 and the driven gear 48 is fed out to the wire guide mechanism 34 so that the wire W is drawn out from the reel 10.

The lock lever 56 is pivotally supported by the lever holder 54 via a pivot axis 56*a*. The lock lever 56 is biased in a direction along which the lock lever 56 contacts with the operation arm 50*b* of the releasing lever 50 by a torsion spring that is not shown. The lock lever 56 includes a recess 56*b* configured to engage with a tip of the operation arm 50*b* of the releasing lever 50.

When a user of the rebar tying tool 2 presses the operation arm 50*b* in against the biasing force of the compression spring 52, the releasing lever 50 pivots about the pivot axis 50*c* and the driven gear 48 separates away from the driving gear 46. At this occasion, the lock lever 56 pivots about the pivot axis 56*a* and the tip of the operation arm 50*b* engages with the recess 56*b*, resulting in the operation arm 50*b* being retained in its pressed-in state. Upon when the wire W, extending from the reel 10 supported by the reel supporting mechanism 30, is to be set in the wire feeding mechanism 32, the user presses the operation arm 50*b* in to separate the driven gear 48 from the driving gear 46, and in that state, arranges an end of the wire W drawn out from the reel 10 between the driving gear 46 and the driven gear 48 through the through hole 42*a* of the guiding member 42. Then, when the user shifts the lock lever 56 in a direction along which the lock lever 56 separates from the operation arm 50*b*, the releasing lever 50 pivots about the pivot axis 50*c* and the driven gear 48 engages with the driving gear 46, and the wire W is held between the V-shaped groove 46*a* of the driving gear 46 and the V-shaped groove 48*a* of the driven gear 48.

The wire guide mechanism 34 shown in FIGS. 5 and 6 guides the wire W fed from the wire feeding mechanism 32 in a loop shape around the rebars R. The wire guide mechanism 34 comprises a guiding pipe 58, an upper curl guide 60, and a lower curl guide 62. A rearward end of the guiding pipe 58 is open toward an interface between the driving gear 46 and the driven gear 48. The wire W fed from the wire feeding mechanism 32 is fed to an inside of the guiding pipe 58. A forward end of the guiding pipe 58 is open toward an inside of the upper curl guide 60. The upper curl guide 60 is provided with a first guiding passage 64 for guiding the wire W fed from the guiding pipe 58, and a second guiding passage 66 (see FIG. 6) for guiding the wire W fed from the lower curl guide 62.

As shown in FIG. 5, the first guiding passage 64 is provided with plural guiding pins 68 for guiding the wire W so as to provide a downward curving profile to the wire W, and a cutter 70 constituting a part of the wire cutting mechanism 38 to be described later. The wire W fed from the guiding pipe 58 is guided by the guiding pins 68 in the first guiding passage 64, passes through the cutter 70, and is fed out from a forward end of the upper curl guide 60 toward the lower curl guide 62.

As shown in FIG. 6, the lower curl guide 62 is provided with a third guiding passage 72. The third guiding passage 72 comprises a right-side guiding wall 72*a* and a left-side guiding wall 72*b* for guiding the wire W fed from the forward end of the upper curl guide 60. The wire W guided by the lower curl guide 62 is fed toward a rear end of the second guiding passage 66 of the upper curl guide 60.

The second guiding passage 66 of the upper curl guide 60 is provided with an upper-side guiding wall 74 that guides the wire W fed from the lower curl guide 62 and feeds the wire W from the forward end of the upper curl guide 60 toward the lower curl guide 62.

The wire W fed from the wire feeding mechanism 32 is wound around the rebars R in the loop shape by the upper curl guide 60 and the lower curl guide 62. When the wire feeding mechanism 32 feeds out a feed amount of the wire W set by the user, it stops the feeding motor 44 to terminate the feeding of the wire W.

The brake mechanism 36 shown in FIG. 3 stops rotation of the reel 10 in conjunction with the stop of the feeding of the wire W by the wire feeding mechanism 32. The brake mechanism 36 comprises a solenoid 76, a link 78, a brake arm 80, and a torsion spring 81. The solenoid 76 of the brake mechanism 36 is connected to the control board 134 by a connection wire that is not shown. The control board 134 is configured to control an operation of the brake mechanism 36. The reel 10 is provided with engaging portions 10*a* with which the brake arm 80 engages, and the engaging portions 10*a* are provided at predetermined angle intervals in a circumferential direction of the reel 10. In a state where the solenoid 76 is not energized, the brake arm 80 is separated from the engaging portions 10*a* of the reel 10 by biasing force of the torsion spring 81. When the solenoid 76 is energized, the brake arm 80 pivots using the link 78 against the biasing force of the torsion spring 81, and the brake arm 80 engages with one of the engaging portions 10*a* of the reel 10. When the feeding of the wire W is performed by the wire feeding mechanism 32, the brake mechanism 36 does not energize the solenoid 76 to separate the brake arm 80 from the engaging portions 10*a* of the reel 10. Due to this, the reel 10 can freely rotate, and the wire feeding mechanism 32 can draw out the wire W from the reel 10. Further, when the feeding of the wire W by the wire feeding mechanism 32 is stopped, the brake mechanism 36 energizes the solenoid 76 to engage the brake arm 80 with one of the engaging portions 10*a* of the reel 10. Due to this, the rotation of the reel 10 is inhibited. Due to this, the wire W can be prevented from becoming loose between the reel 10 and the wire feeding mechanism 32 by the reel 10 continuing to rotate by inertia even after the wire feeding mechanism 32 had stopped feeding out the wire W.

The wire cutting mechanism 38 shown in FIG. 5 cuts the wire W in a state where the wire W is wound around the rebars R. The wire cutting mechanism 38 comprises the cutter 70 and a link 82. The link 82 rotates the cutter 70 in cooperation with the wire twisting mechanism 40 to be described later. The wire W passing through an inside of the cutter 70 is cut by the rotation of the cutter 70.

The wire twisting mechanism 40 shown in FIG. 6 ties the rebars R with the wire W by twisting the wire W wound around the rebars R. The wire twisting mechanism 40 comprises a twisting motor 84, a reduction mechanism 86, a screw shaft 88 (see FIG. 5), a sleeve 90, and a pair of hooks 92.

Rotation of the twisting motor 84 is transmitted to the screw shaft 88 through the reduction mechanism 86. The twisting motor 84 is configured to rotate in a forward direction or in a reverse direction, and the screw shaft 88 is configured to rotate in the forward direction or in the reverse direction according to the rotation of the twisting motor 84. The twisting motor 84 is connected to the control board 134 by a connection wire that is not shown. The control board 134 is configured to control an operation of the twisting motor 84. The sleeve 90 is arranged to cover a periphery of the screw shaft 88. In a state where rotation of the sleeve 90 is inhibited, the sleeve 90 moves forward when the screw shaft 88 rotates in the forward direction, and when the screw shaft 88 rotates in the reverse direction, the sleeve 90 moves backward. Further, in a state where the rotation of the sleeve 90 is allowed, the sleeve 90 rotates with the screw shaft 88 when the screw shaft 88 rotates. Further, when the sleeve 90 moves forward from its initial position to a predetermined position, the link 82 of the wire cutting mechanism 38 rotates the cutter 70. The pair of hooks 92 is provided at a forward end of the sleeve 90, and it opens and closes according to a position of the sleeve 90 in a forward-and-backward direction. When the sleeve 90 moves forward, the pair of hooks 92 closes and holds the wire W. On the contrary, when the sleeve 90 moves backward, the pair of hooks 92 opens and releases the wire W.

The wire twisting mechanism 40 rotates the twisting motor 84 in the state where the wire W is wound around the rebars R. At this occasion, the rotation of the sleeve 90 is inhibited, so the sleeve 90 and the pair of hooks 92 both move forward by the rotation of the screw shaft 88, and the pair of hooks 92 closes to hold the wire W. Then, when the rotation of the sleeve 90 is allowed, the sleeve 90 and the pair of hooks 92 rotate by the rotation of the screw shaft 88. Due to this, the wire W is twisted and the rebars R are thereby tied. Twisting intensity for the wire W can be set in advance by the user. When the wire W is twisted to the preset twisting intensity, the wire twisting mechanism 40 rotates the twisting motor 84 in the reverse direction. At this occasion, the rotation of the sleeve 90 is inhibited, so the sleeve 90 moves backward by the rotation of the screw shaft 88, and the pair of hooks 92 also moves backward while gradually opening, resulting in releasing the wire W. Thereafter, the pair of hooks 92 moves backward to its initial position and the rotation of the sleeve 90 is allowed, and the pair of hooks 92 thereby returns to its initial angle.

As shown in FIG. 1, when the user arranges the rebar tying tool 2 so that the plural rebars R are positioned between the upper curl guide 60 and the lower curl guide 62, and pulls the trigger 7, the rebar tying tool 2 performs a series of motions to wind the wire W around the rebars R by the wire feeding mechanism 32, the wire guide mechanism 34, and the braking mechanism 36, and to cut and twist the wire W wound on the rebars R by the wire cutting mechanism 38 and the wire twisting mechanism 40.

Hereinbelow, details of the reel supporting mechanism 30 will be described. As shown in FIGS. 7 to 11, the reel supporting mechanism 30 comprises a reel loading chamber 94, a fixed bearing 96, a cover holder 98, a movable bearing 100, and the cover 116 (see FIG. 9). It should be noted that, for clearer depiction in the drawings, the reel 10 and the cover 116 are omitted in FIGS. 7 and 8.

The reel loading chamber 94 has a shape by which the reel 10 can be placed inside thereof. The reel loading chamber 94 has its top portion opened, and the reel 10 can be inserted into or taken out from this top portion. A front surface of the reel loading chamber 94 is defined by the inner housing 16. A right surface of the reel loading chamber 94 is defined by the right outer housing 12 and the inner housing 16. A left surface of the reel loading chamber 94 is defined by the left outer housing 14. Rear and bottom surfaces of the reel loading chamber 94 are defined by the right outer housing 12, the left outer housing 14, and the inner housing 16. Along a front-and-rear direction of the tying tool body 4, the front, bottom, and rear surfaces of the reel loading chamber 94 have an arc shape bulging downward. Due to this, when the reel 10 is set in the reel loading chamber 94, the reel 10 is placed on a lowermost portion of the bottom surface of the reel loading chamber 94.

Figure 7:
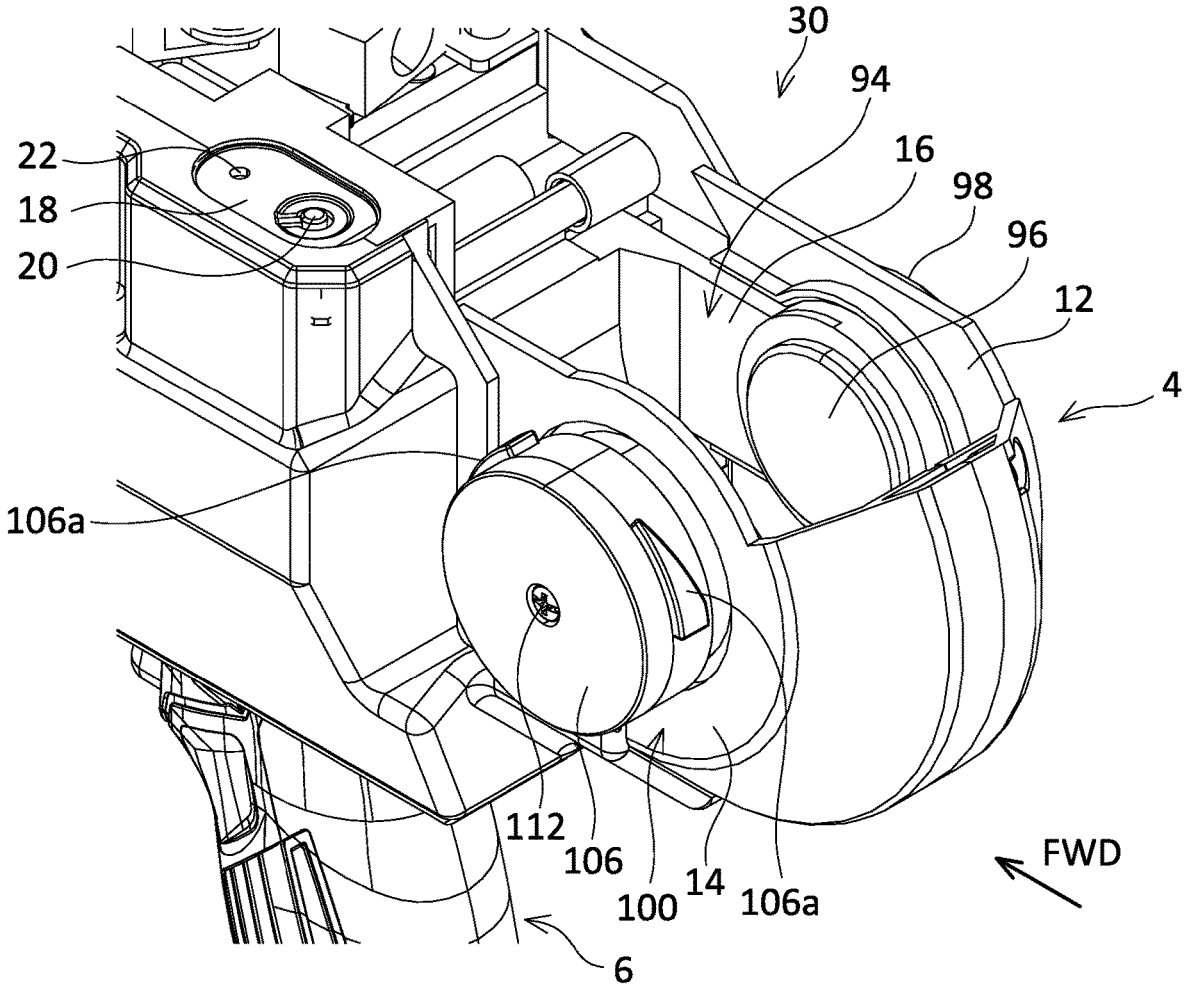
FIG. 7 is a perspective view that sees a reel supporting mechanism 30 of the rebar tying tool 2 according to the embodiment from the upper-left rear side.
Figure 10:
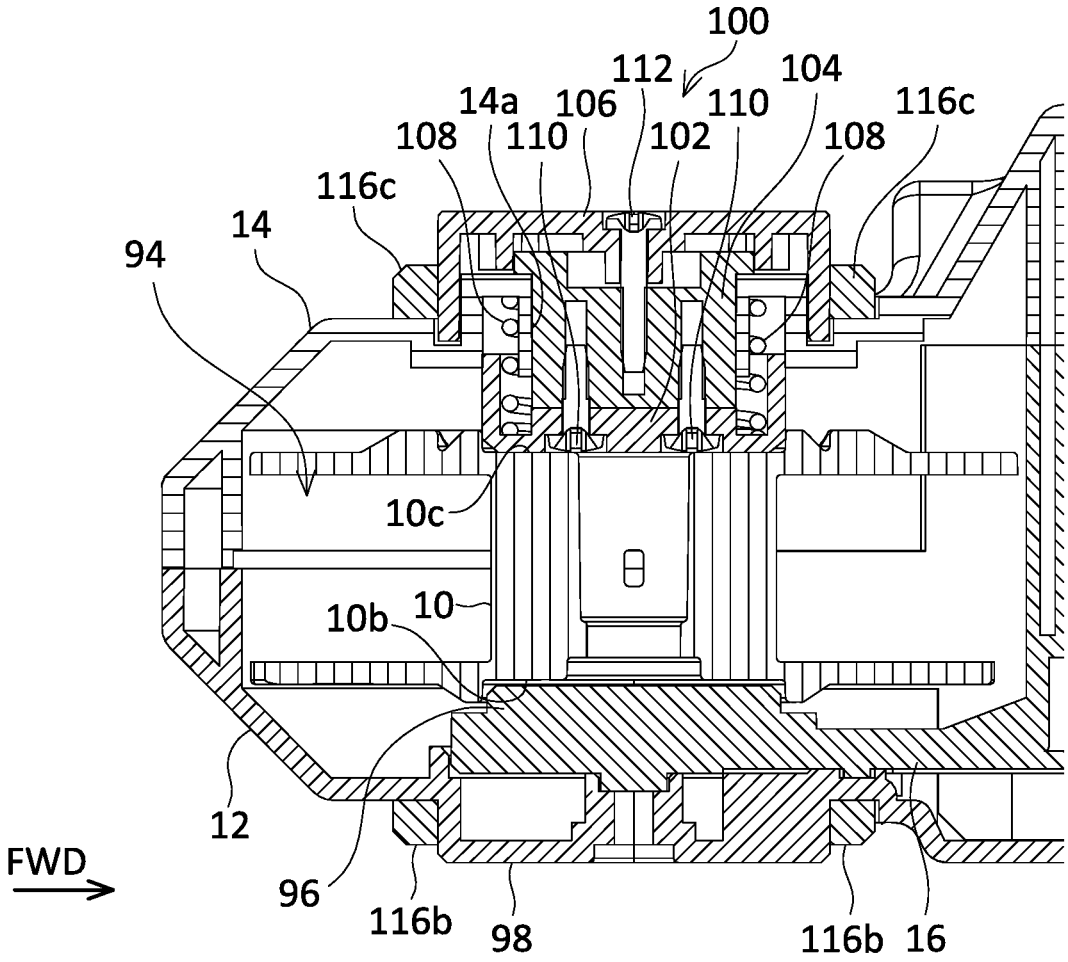
FIG. 10 is a cross sectional view that sees an internal structure of the reel supporting mechanism 30 of the rebar tying tool 2 according to the embodiment from an upper side, with the cover 116 being completely closed.

As shown in FIG. 7, the fixed bearing 96 is arranged to protrude toward the inside of the reel loading chamber 94 from the right surface of the reel loading chamber 94. Specifically, the fixed bearing 96 is arranged on a surface of the inner housing 16 that faces the left outer housing 14 so as to protrude toward the left outer housing 14. In the present embodiment, the fixed bearing 96 is integrated with the inner housing 16. The fixed bearing 96 has a cylindrical outer shape. A center axis of the cylindrical shape of the fixed bearing 96 substantially matches a left-and-right direction of the tying tool body 4. A corner at a distal end of the fixed bearing 96 has a tapered shape. As shown in FIG. 10, a cylinder-shaped bearing groove **10*b* is provided at a center of a surface of the reel 10 that faces the fixed bearing 96. The fixed bearing 96 engages with the bearing groove 10*b* of the reel 10 to rotatably support the reel 10**.

Figure 8:
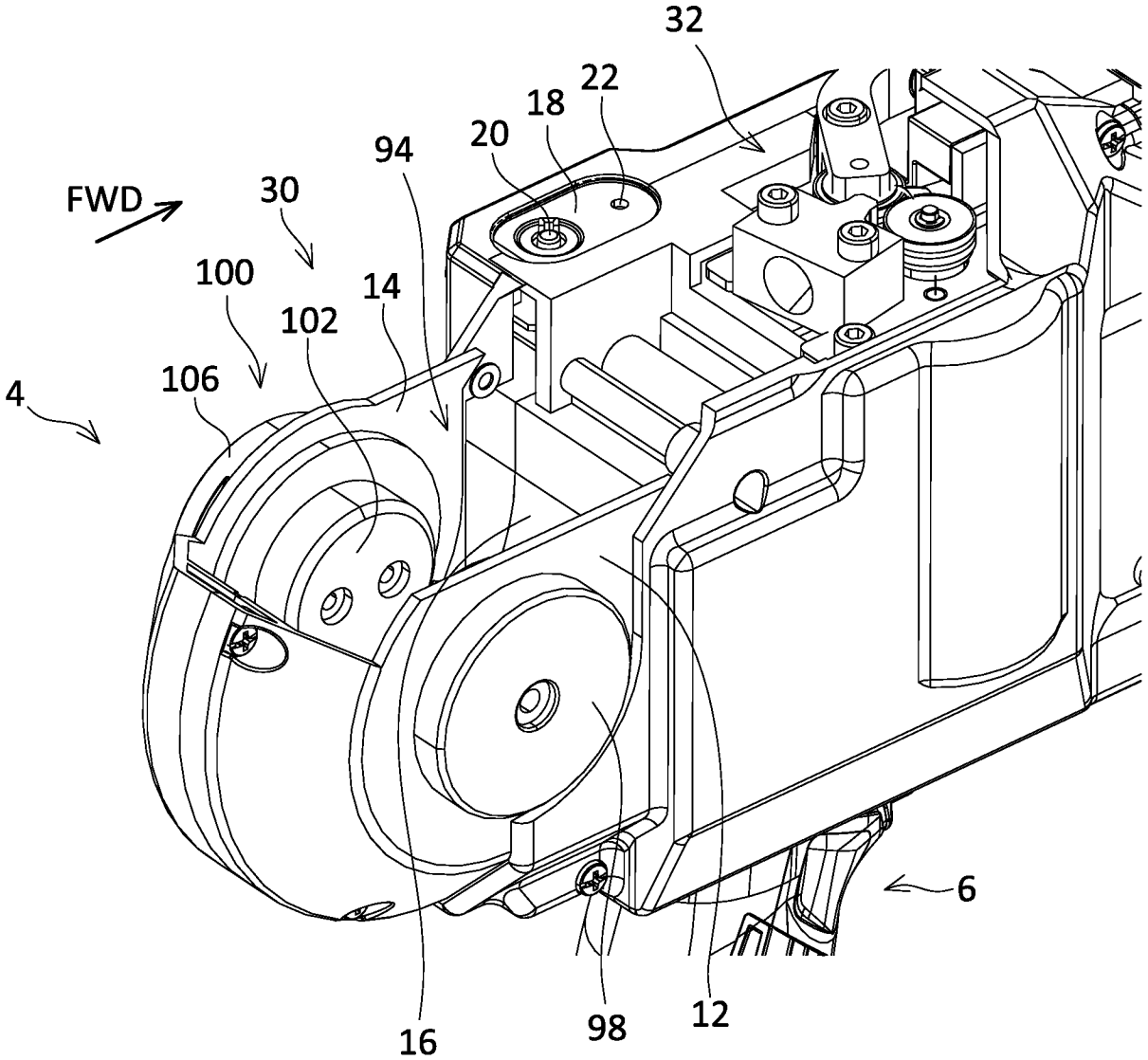
FIG. 8 is a perspective view that sees the reel supporting mechanism 30 of the rebar tying tool 2 according to the embodiment from the upper-right rear side.

As shown in FIG. 8, the cover holder 98 is arranged on an outer surface of the right outer housing 12. In this embodiment, the cover holder 98 is integrated with the right outer housing 12. The cover holder 98 has a cylindrical outer shape. A center axis of the cylindrical shape of the cover holder 98 substantially matches the center axis of the cylindrical shape of the fixed bearing 96.

The movable bearing 100 is arranged on the left surface of the reel loading chamber 94. Specifically, the movable bearing 100 is arranged to penetrate the left outer housing 14. As shown in FIG. 10, the movable bearing 100 comprises a bearing member 102, a relay member 104, a cover holder member 106, and a compression spring 108.

As shown in FIG. 8, the bearing member 102 is arranged to protrude from the left surface of the reel loading chamber 94 into the inside of the reel loading chamber 94. The bearing member 102 has a cylindrical outer shape. A corner at a distal end of the bearing member 102 has a tapered shape. A center axis of the cylindrical shape of the bearing member 102 substantially matches the center axis of the cylindrical shape of the fixed bearing 96. It should be noted that, hereinbelow, the center axis of the cylindrical shape of the bearing member 102 may be referred to as a center axis of the movable bearing 100. As shown in FIG. 10, a cylinder-shaped bearing groove **10*c* is provided at a center of a surface of the reel 10 that faces the bearing member 102. The bearing member 102 engages with the bearing groove 10*c* of the reel 10 to rotatably support the reel 10. The bearing member 102 is fixed to the relay member 104 via fixation pieces 110**.

Figure 11:
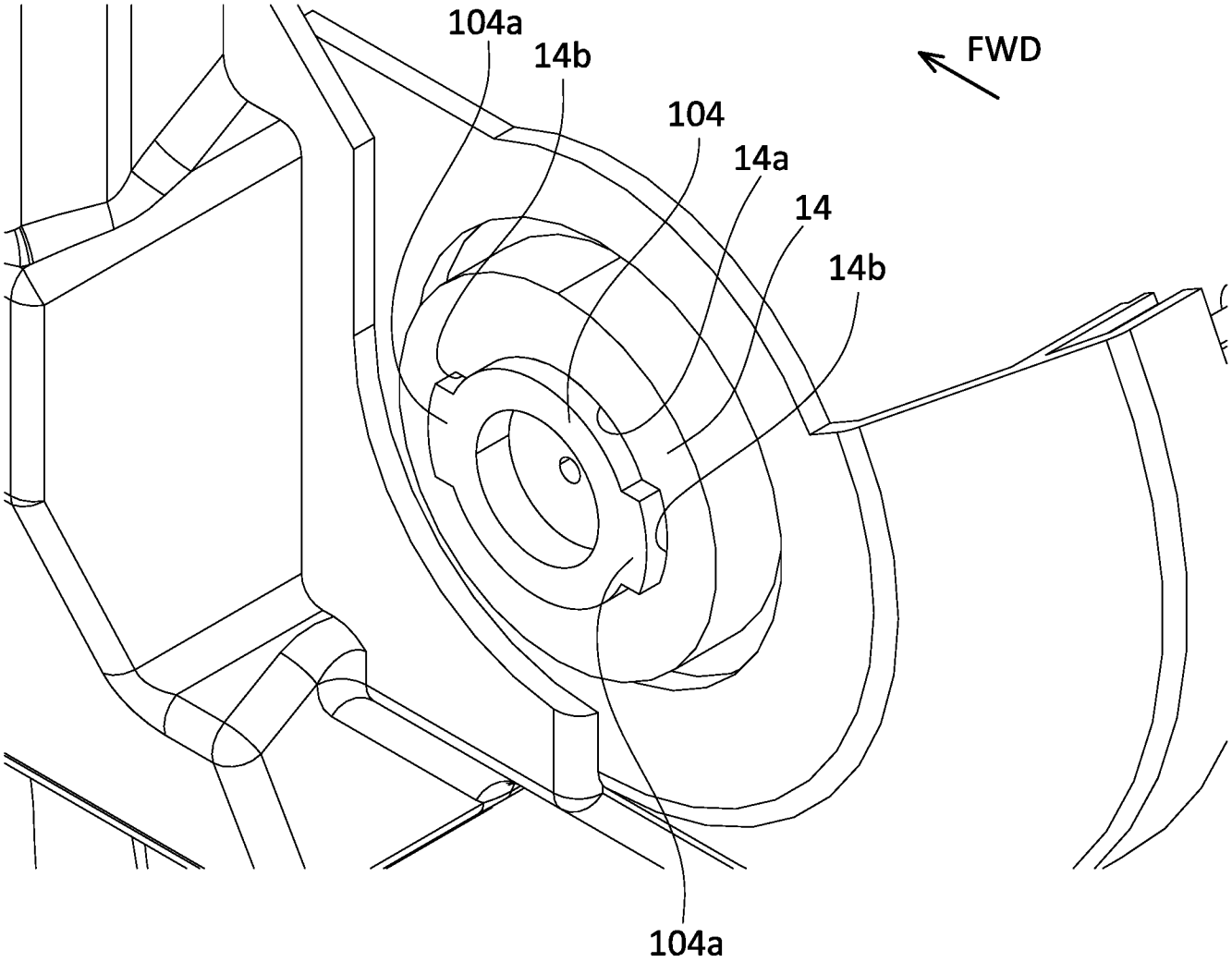
FIG. 11 is a perspective view that sees a left outer housing 14 and a relay member 104 of the rebar tying tool 2 according to the embodiment from the upper-left rear side.

As shown in FIG. 11, the relay member 104 is supported by the left outer housing 14 by penetrating through a through hole **14*a* provided on the left outer housing 14. The relay member 104 is supported by the left outer housing 14 so as to be slidable along a center axis direction of the movable bearing 100 (that is, the left-and-right direction of the tying tool body 4). Projections 104*a* that extend along the center axis direction of the movable bearing 100 are provided on an outer surface of the relay member 104, and recesses 14*b* corresponding to the projections 104*a* are provided in the through hole 14*a*. Due to this, the relay member 104 is supported by the left outer housing 14 so as to be incapable of rotating about the center axis of the movable bearing 100 (that is, about the left-and-right direction of the tying tool body 4). As shown in FIG. 10, the relay member 104 is fixed to the cover holder member 106 via a fixation piece 112**.

As shown in FIG. 7, the cover holder member 106 is arranged outside the left outer housing 14. The cover holder member 106 has a cylindrical outer shape. A center axis of the cylindrical shape of the cover holder member 106 substantially matches the center axis of the cylindrical shape of the bearing member 102. Further, cam projections **106*a* are provided on a cylindrical outer surface of the cover holder member 106** at predetermined angle intervals in a circumferential direction.

As shown in FIG. 10, the compression spring 108 couples the left outer housing 14 and the bearing member 102. The compression spring 108 biases the bearing member 102 in a direction approaching the fixed bearing 96.

Figure 9:
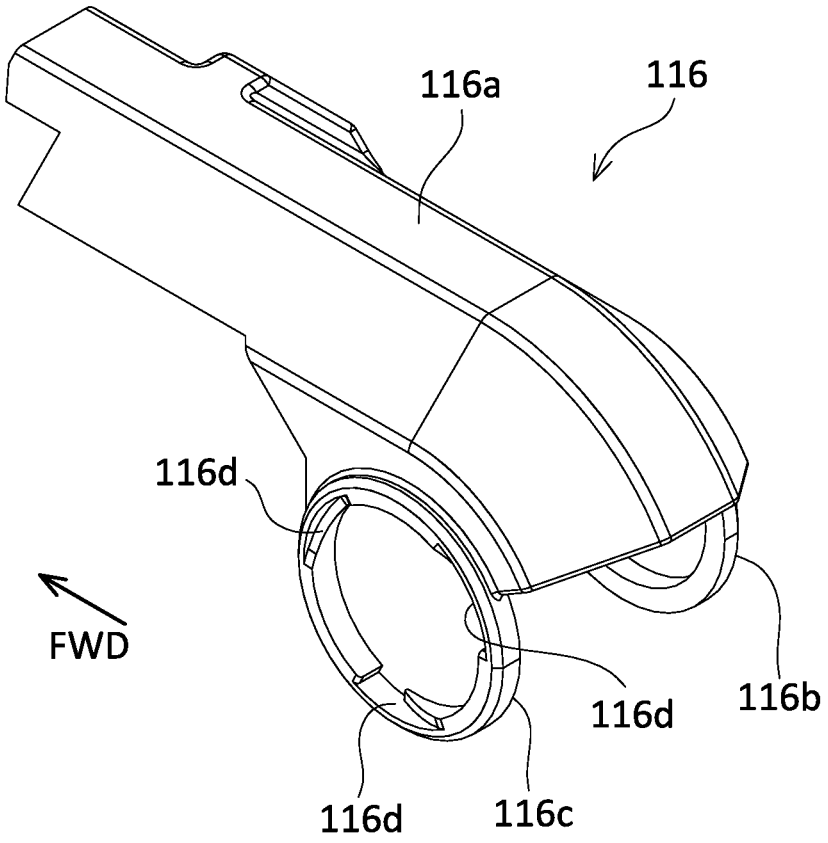
FIG. 9 is a perspective view that sees a cover 116 of the rebar tying tool 2 according to the embodiment from the upper-left rear side.

As shown in FIG. 9, the cover 116 comprises a cover body 116*a*, a right-side attachment 116*b*, and a left-side attachment 116*c*. The cover body 116*a* has a shape that covers the top portion of the reel loading chamber 94 and a top portion of the wire feeding mechanism 32. More specifically, the cover body 116*a* has a shape that covers the reel 10 inside the reel loading chamber 94, and the guiding member 42, the base member 43, the driving gear 46, and the driven gear 48 of the wire feeding mechanism 32 from above. With the cover body 116*a* covering the top portion of the reel loading chamber 94, the wire W is prevented from loosening and being detached from the reel 10, and water, dust, sand, and the like can be prevented from entering into the reel loading chamber 94 from outside. With the cover body 116*a* covering the top portion of the wire feeding mechanism 32, water, dust, sand, and the like can be prevented from entering into the wire feeding mechanism 32 from outside. The cover body 116*a* has a shape that is easily gripped by the user of the rebar tying tool 2 from its left and right sides for easy opening and closing operations of the cover 116. It should be noted that a projection or a recess to place user's finger on when the user pulls the cover 116 up backwards may be provided on the cover body 116*a*. Further, the cover body 116*a* is constituted of a transparent material such that the user can visibly recognize a state of the reel 10 from outside even when the cover 116 is closed.

The right-side attachment 116*b* has a ring shape that can be attached slidably on an outer surface of the cover holder 98 shown in FIG. 8. The left-side attachment 116*c* has a ring shape that can be attached slidably on the outer surface of the cover holder member 106 of the movable bearing 100 shown in FIG. 7. Further, the left-side attachment 116*c* is provided with cam grooves 116*d* at the predetermined angle intervals in the circumferential direction so as to correspond to the cam projections 106*a* of the cover holder member 106. The cam grooves 116*d* are arranged at positions and are given a shape, by which the cam projections 106*a* enter completely therein when the cover 116 is completely closed. Further, the cam grooves 116*d* are arranged so as to be disconnected with the cam projections 106*a* when the cover 116 is completely opened. The cam projections 106*a* and the cam grooves 116*d* constitute a cam mechanism.

Figure 12:
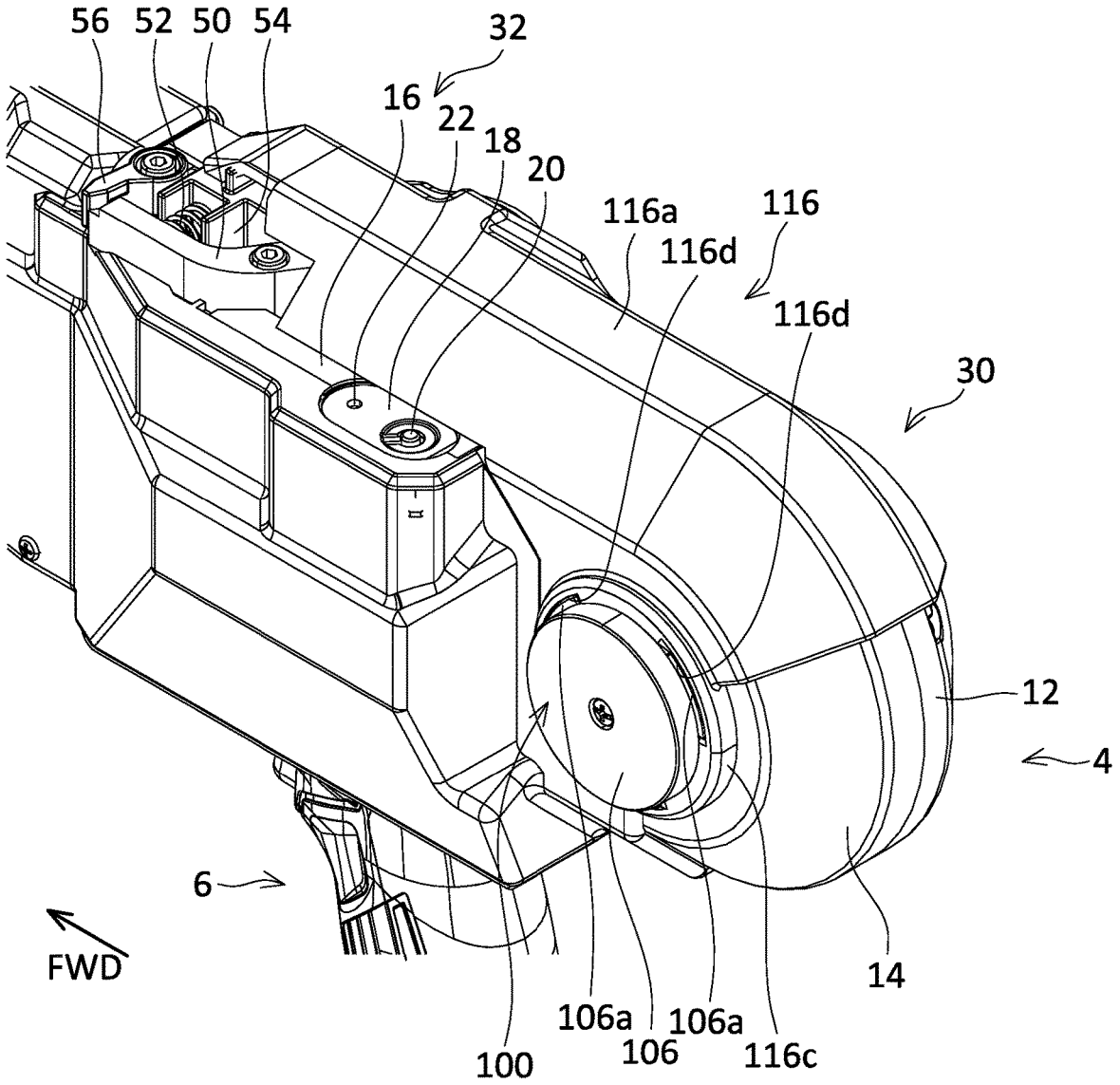
FIG. 12 is a perspective view that sees a state of the reel supporting mechanism 30 of the rebar tying tool 2 according to the embodiment from the upper-left rear side when the cover 116 is completely closed.
Figure 13:
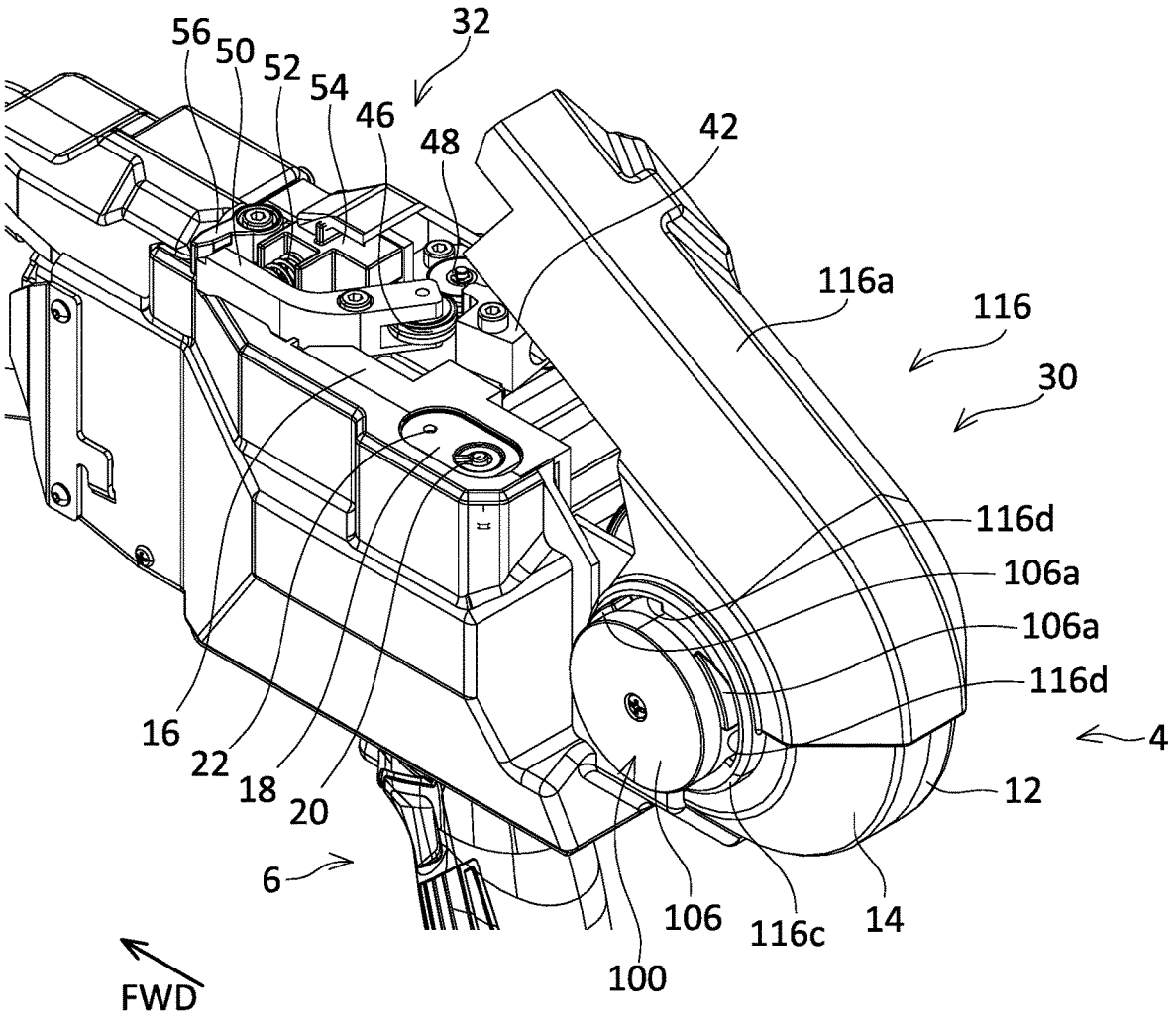
FIG. 13 is a perspective view that sees a state of the reel supporting mechanism 30 of the rebar tying tool 2 according to the embodiment from the upper-left rear side when the cover 116 is somewhat opened.
Figure 14:
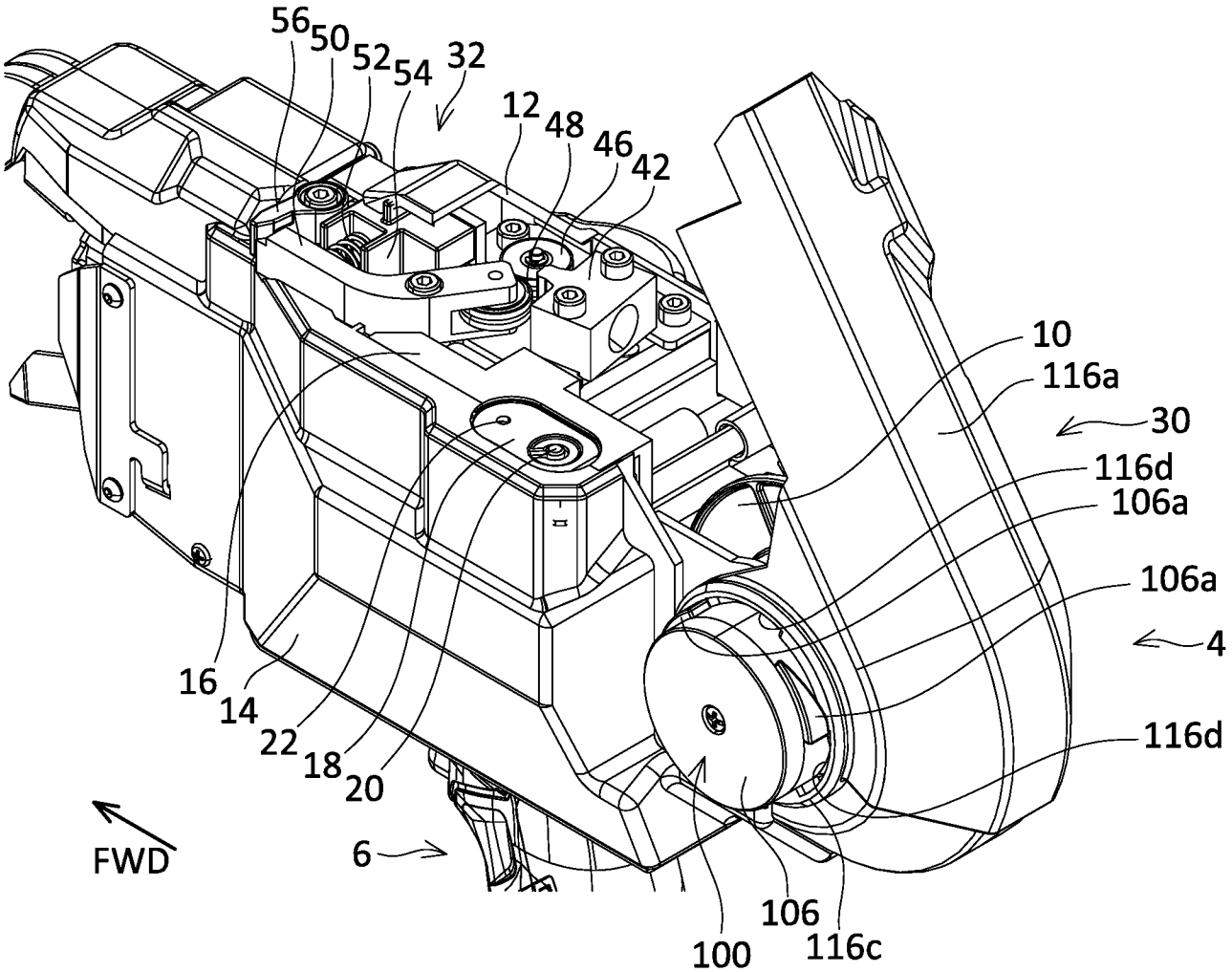
FIG. 14 is a perspective view that sees a state of the reel supporting mechanism 30 of the rebar tying tool 2 according to the embodiment from the upper-left rear side when the cover 116 is further opened.

As shown in FIG. 12, when the cover 116 is completely closed, the compression spring 108 applies the biasing force toward a right side of the tying tool body 4 (that is, in the direction approaching the fixed bearing 96) on the bearing member 102, the relay member 104, and the cover holder member 106, so a force in a direction along which the cam projections 106*a* are pressed into the cam grooves 116*d* is acting thereon. That is, in a closed state where the cover 116 is closed, the closed state is maintained by the biasing force of the compression spring 108. When the user of the rebar tying tool 2 grips the cover body 116*a* and pulls up the cover body 116*a* backward against the biasing force of the compression spring 108 from the closed state, the right-side attachment 116*b* rotates while sliding relative to the cover holder 98 and the left-side attachment 116*c* also rotates while sliding relative to the cover holder member 106. At this timing, as shown in FIG. 13, the cam projections 106*a* are gradually pushed out from the cam grooves 116*d*, and the cover holder member 106, the relay member 104, and the bearing member 102 collectively move toward a left side of the tying tool body 4 (that is, in a direction separating from the fixed bearing 96). It should be noted that if the user of the rebar tying tool 2 releases the cover body 116*a* from his/her hand in this state, the force that presses the cam projections 106*a* into the cam grooves 116*d* is exerted by the biasing force of the compression spring 108, the cover 116 pivots in its closing direction, and the cover 116 returns to its closed state. When the user of the rebar tying tool 2 further pulls up the cover body 116*a* backward against the biasing force of the compression spring 108 from the state shown in FIG. 13, the cam projections 106*a* become completely disconnected from the cam grooves 116*d* as shown in FIG. 14, and the cam projections 106*a* slide while making contact with portions of the left-side attachment 116*c* where the cam grooves 116*d* are not provided. It should be noted that even if the user of the rebar tying tool 2 releases the cover body 116*a* from his/her hand in this state, the biasing force of the compression spring 108 does not act as the force in the direction to close the cover 116 since the cam projections 106*a* are located at positions disconnected from the cam grooves 116*d*, and thus the cover 116 maintains its current open angle as it is. When the user of the rebar tying tool 2 further pulls up the cover body 116*a* backward from the state shown in FIG. 14, the cover 116 becomes completely opened as shown in FIG. 15.

Figure 15:
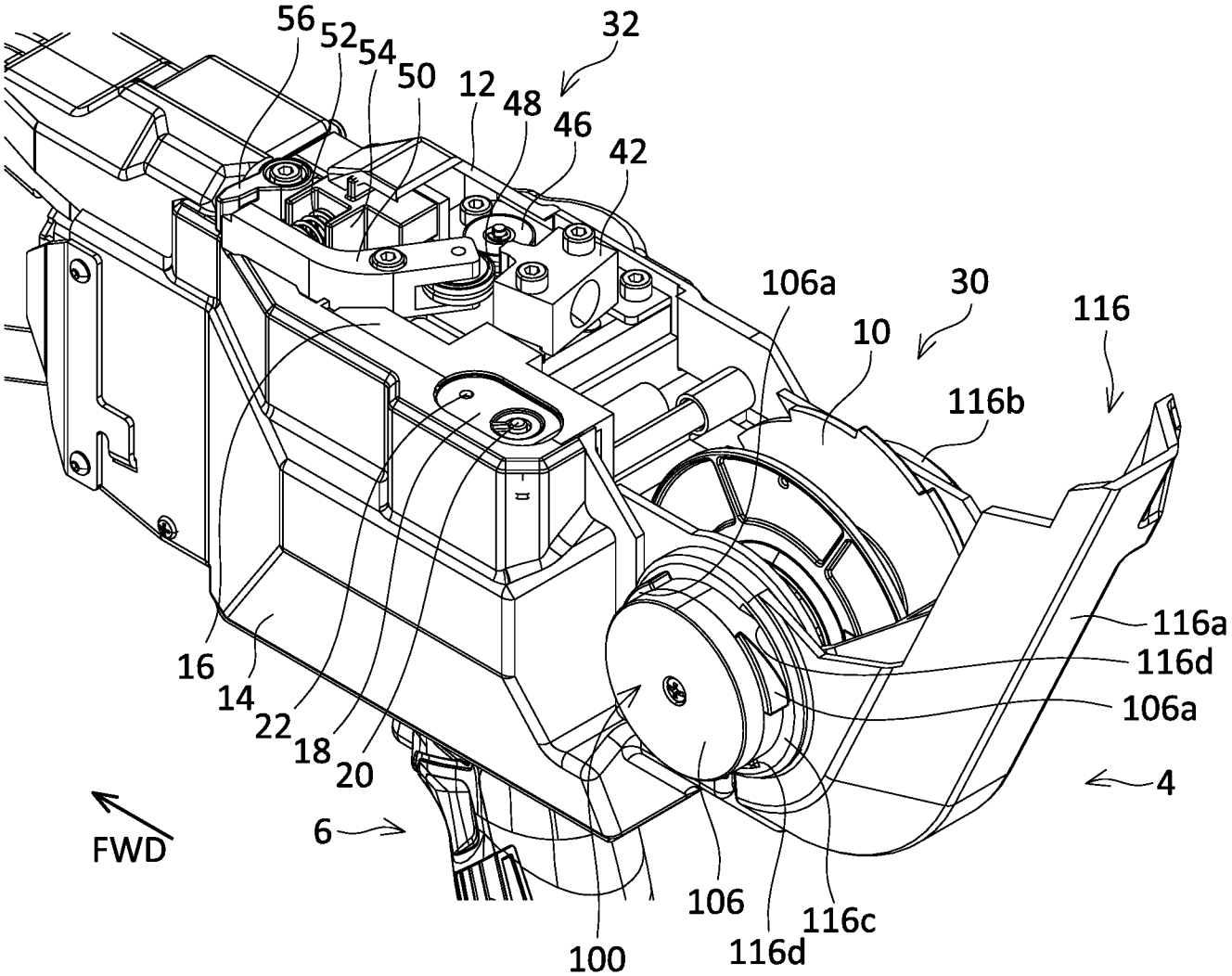
FIG. 15 is a perspective view that sees a state of the reel supporting mechanism 30 of the rebar tying tool 2 according to the embodiment from the upper-left rear side when the cover 116 is completely opened.

When the user of the rebar tying tool 2 grips the cover body 116*a* and pushes down the cover body 116*a* forward from the state shown in FIG. 15 where the cover 116 is completely opened, the right-side attachment 116*b* rotates while sliding relative to the cover holder 98, and the left-side attachment 116*c* also rotates while sliding relative to the cover holder member 106. Then, as shown in FIGS. 14 and 13, when the cam projections 106*a* shifts, by the rotation of the cover 116, from the state where the cam projections 106*a* are completely disconnected from the cam grooves 116*d* to the state where the cam projections 106*a* has entered into the cam grooves 116*d*, the bearing member 102, the relay member 104, and the cover holder member 106 collectively move toward the right side of the tying tool body 4 (that is, in the direction approaching the fixed bearing 96) by the biasing force of the compression spring 108. Further, since the force in the direction to press the cam projections 106*a* into the cam grooves 116*d* is exerted by the biasing force of the compression spring 108, the cover 116 pivots in its closing direction even if the user of the rebar tying tool 2 releases the cover body 116*a* from his/her hand, and the cover 116 becomes completely closed as shown in FIG. 12.

Figure 16:
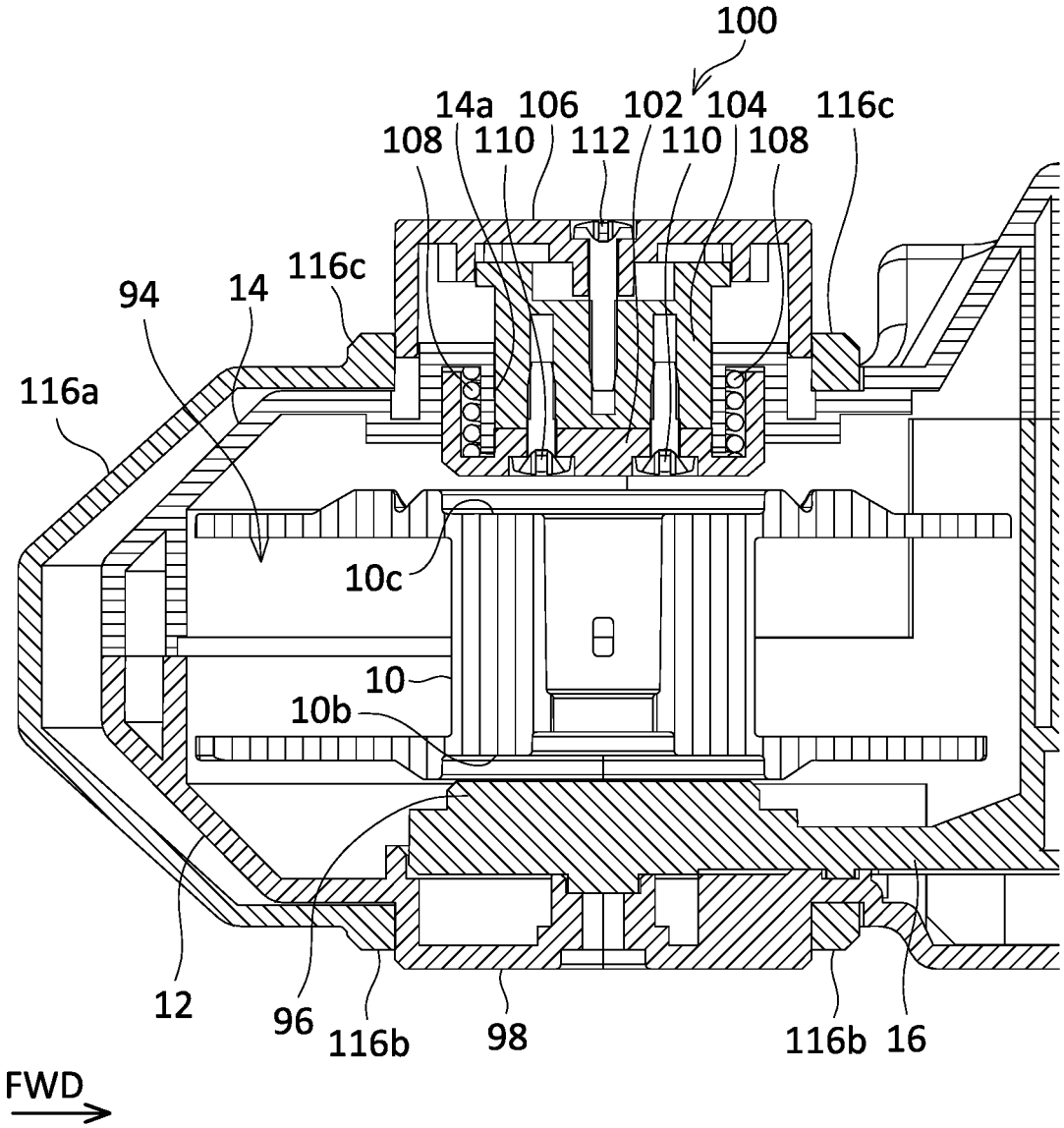
FIG. 16 is a cross sectional view that sees the internal structure of the reel supporting mechanism 30 of the rebar tying tool 2 according to the embodiment from the upper side, with the cover 116 being completely opened.

Procedures for setting the reel 10 in the rebar tying tool 2 will be described. Firstly, the user brings the cover 116 to its opened state, and places the reel 10 in the reel loading chamber 94. As shown in FIG. 16, at this timing, the bearing member 102 is arranged at a position where it does not interfere with the reel 10 upon inserting the reel 10 into or taking out the reel 10 from the reel loading chamber 94, so the reel 10 is placed on the bottom surface of the reel loading chamber 94 without engaging with the fixed bearing 96 or the bearing member 102. In this state, the reel 10 can be said as being detachably supported by the reel supporting mechanism 30. Thereafter, the user draws out the wire W from the reel 10, and sets the wire W in the wire feeding mechanism 32. Thereafter, when the user closes the cover 116, the bearing member 102 moves, along the direction approaching the fixed bearing 96, to a position where it engages with the bearing groove 10*c* of the reel 10, and as shown in FIG. 10, the bearing member 102 engages with the bearing groove 10*c* of the reel 10 and the bearing groove 10*b* of the reel 10 also engages with the fixed bearing 96, as a result of which the reel 10 is undetachably supported by the reel supporting mechanism 30.

As shown in FIG. 10, in the state where the reel 10 is set in the rebar tying tool 2, the reel 10 is supported rotatably by the fixed bearing 96 and the bearing member 102. When the wire W is to be drawn out from the reel 10 by the wire feeding mechanism 32, the reel 10 rotates while sliding relative to the fixed bearing 96 and the bearing member 102. It should be noted that the reel 10 may be configured to rotate without sliding relative to the fixed bearing 96 by configuring the fixed bearing 96 to be rotatable relative to the inner housing 16, or the reel 10 may be configured to rotate without sliding relative to the bearing member 102.

Procedures to remove the reel 10 from the rebar tying tool 2 will be described. When the user opens the cover 116, the bearing member 102 separates away from the bearing groove 10*c* of the reel 10 and the bearing groove 10*b* of the reel 10 also separates away from the fixed bearing 96 by the bearing member 102 moving in the direction separating from the fixed bearing 96, which leaves the reel 10 in the state of being placed on the bottom surface of the reel loading chamber 94. As shown in FIG. 16, under this state, the bearing member 102 has moved to the position where the bearing member 102 does not interfere with the reel 10 when the reel 10 is inserted into or taken out from the reel loading chamber 94. The user detaches the wire W extending from the reel 10 from the wire feeding mechanism 32, and thereafter can remove the reel 10 from the reel loading chamber 94.

As above, in the rebar tying tool 2 of the present embodiment, the reel supporting mechanism 30 switches, in accordance with the user's operation to open or close the cover 116, between the state having the reel 10 placed on the bottom surface of the reel loading chamber 94, that is, the state of detachably supporting the reel 10, and the state of rotatably supporting the reel 10 by the fixed bearing 96 and the bearing member 102, that is, the state of undetachably supporting the reel 10. By configuring as above, work performance of setting and removing the reel 10 can further be improved.

As shown in FIG. 15, in the rebar tying tool 2 of the present embodiment, when the cover 116 is open and the reel 10 is placed on the bottom surface of the reel loading chamber 94, an upper portion of the reel 10 protrudes upward than the right outer housing 12, the left outer housing 14, and the inner housing 16, and protrudes to an outside of the tying tool body 4. By configuring as above, the reel 10 can be more easily gripped when the user removes the reel 10. It should be noted that since the right outer housing 12 and the inner housing 16 defining the right surface of the reel loading chamber 94, and the left outer housing 14 defining the left surface of the reel loading chamber 94 constitute a supporting structure for the fixed bearing 96, the cover holder 98, and the movable bearing 100, heights of upper ends of these housings cannot be lowered to a great extent in a vicinity of the center axes of the fixed bearing 96, the cover holder 98, and the movable bearing 100 in the front-and-rear direction of the tying tool body 4. However, by configuring the heights of the upper ends of these housings lower on a front side or on a rear side relative to the center axes of the fixed bearing 96, the cover holder 98, and the movable bearing 100 along the front-and-rear direction of the tying tool body 4, as compared to the heights thereof in the vicinity of the center axes, the user can more easily grip the reel 10 upon removing the reel 10.

In the rebar tying tool 2 of the present embodiment, the cover body 116*a* of the cover 116 has a shape that covers the top portions of the reel supporting mechanism 30 and the wire feeding mechanism 32. According to such a configuration, the top portions of the reel supporting mechanism 30 and the wire feeding mechanism 32 are open in the state where the cover 116 is open, so the user who has gripped onto the rebar tying tool 2 can easily and visibly recognize insides of the reel supporting mechanism 30 and the wire feeding mechanism 32 from above.

In the rebar tying tool 2 of the present embodiment, a pivot axis of the cover 116 substantially matches a rotating axis of the reel 10 when the reel 10 is rotatably supported by the fixed bearing 96 and the bearing member 102. In this case, a size of the rebar tying tool 2 when the cover 116 is open can be made compact as compared to a case where the pivot axis of the cover 116 is arranged on a surface of the rebar tying tool 4, for example, on a rear end of the tying tool body 4.

In the rebar tying tool 2 of the present embodiment, the cover body 116*a* of the cover 116 has the shape that covers both of the reel supporting mechanism 30 and the wire feeding mechanism 32. As an alternative to this configuration, the cover body 116*a* of the cover 116 may have a shape that covers only the reel supporting mechanism 30, or a shape that covers only the wire feeding mechanism 32.

In the rebar tying tool 2 of the present embodiment, both of the distal end of the fixed bearing 96 and the distal end of the bearing member 102 have the tapered shape. Due to this, even if the reel 10 is not positioned appropriately relative to the fixed bearing 96 and the bearing member 102 in the state where the cover 116 is opened and the reel 10 is placed on the bottom surface of the reel loading chamber 94, the tapered shape of the distal end of the bearing member 102 serves as a guide to engage the bearing member 102 to the bearing groove 10*c* of the reel 10, and the tapered shape of the distal end of the fixed bearing 96 also serves as another guide to engage the fixed bearing 96 to the bearing groove 10*b* of the reel 10 when the cover 116 is closed and the bearing member 102 moves towards the fixed bearing 96. The reel 10 can surely be supported by the fixed bearing 96 and the bearing member 102 even if the reel 10 is not positioned appropriately relative to the fixed bearing 96 and the bearing member 102 in the state where the reel 10 is placed on the bottom surface of the reel loading chamber 94.

In the rebar tying tool 2 of the present embodiment, the cover 116 and the bearing member 102 operate interconnectedly via the cam mechanism configured of the cam projections 106*a* and the cam grooves 116*d*. As an alternative to this configuration, for example, a sensor for detecting opened or closed state of the cover 116, and an actuator that drives the bearing member 102 according to a detected signal from the sensor may be provided, and the cover 116 and the bearing member 102 may be configured to operate interconnectedly via an electric circuit. It should be noted that, in the case where the cover 116 and the bearing mechanism 102 operate interconnectedly via the cam mechanism configured of the cam projections 106*a* and the cam grooves 116*d* as in the rebar tying tool 2 of the present embodiment, the cover 116 and the bearing member 102 operate interconnectedly by a mechanical interconnection, thus malfunction can be suppressed as compared to the case where the cover 116 and the bearing member 102 operate interconnectedly via such an electric circuit. It should be noted that, in the rebar tying tool 2 of the present embodiment, the cover 116 that opens and closes by pivot motion is explained, however, as an alternative to this configuration, a cover that opens and closes by sliding may be employed, or a removable cover may be employed.

While specific examples of the present invention have been described above in detail, these examples are merely illustrative and place no limitation on the scope of the patent claims. The technology described in the patent claims also encompasses various changes and modifications to the specific examples described above. The technical elements explained in the present description or drawings provide technical utility either independently or through various combinations. The present invention is not limited to the combinations described at the time the claims are filed. Further, the purpose of the examples illustrated by the present description or drawings is to satisfy multiple objectives simultaneously, and satisfying any one of those objectives gives technical utility to the present invention.

What is claimed is:

1. A rebar tying tool comprising:

a tying tool body including:

a housing, a reel supporting mechanism that is configured to support a reel on which a wire is wound, and includes a reel loading chamber, a wire feeding mechanism configured to feed the wire supplied from the reel, the wire feeding mechanism including a driving gear and a driven gear that are configured to hold and feed the wire, the driving gear and the driven gear being uncovered by the housing on an upper side thereof, a wire twisting mechanism that is configured to twist the wire, and includes a twisting motor, and a cover configured to:

open and close with respect to the housing, allow the reel to be set to and removed from the reel supporting mechanism in an opened state where the cover is opened, and cover the reel supported by the reel supporting mechanism and at least a part of the wire feeding mechanism in a closed state where the cover is closed;

a grip connected to a lower portion of the tying tool body, the grip including a trigger for activating the wire feeding mechanism and the wire twisting mechanism, the trigger being disposed at an upper portion of the grip; and a battery interface connected to a lower portion of the grip, wherein:

when the cover is in the opened state, the driving gear and the driven gear are exposed to the outside, when the cover is in the closed state, the driving gear and the driven gear are covered by the cover so that the driving gear and the driven gear are not exposed to the outside, the reel supporting mechanism is configured to support the reel such that the reel is rotatable with respect to the housing about a rotation axis, the cover is configured to pivot with respect to the housing about a pivot axis, and the pivot axis of the cover is coaxial with the rotation axis of the reel.

2. The rebar tying tool according to claim 1, wherein:

the wire feeding mechanism further includes:

a guiding member that includes a through hole and is configured to guide the wire;

a releasing lever supporting the driven gear, the releasing lever being configured to switch between a first state in which the driven gear is in contact with the driving gear and a second state in which the driven gear is separated from the driving gear; and a lock lever configured to retain the releasing lever in the second state, and in the closed state, the cover is configured to:

cover at least the guiding member, the driving gear, and the driven gear, and not cover the lock lever, the guiding member, the releasing lever, and the lock lever are uncovered by the housing on an upper side thereof, when the cover is in the opened state, the guiding member is exposed to the outside, and when the cover is in the closed state, the guiding member is covered by the cover so that the guiding member is not exposed to the outside.

3. The rebar tying tool according to claim 2, wherein:

the releasing lever includes:

a gear arm supporting the driven gear; and an operation arm connected to the gear arm, the operation arm being configured to be operated by a user, the releasing lever is configured to pivot with respect to the housing about a pivot axis disposed between the gear arm and the operation arm, and the cover does not cover the operation arm in the closed state.

4. The rebar tying tool according to claim 3, wherein:

the wire feeding mechanism further includes a compression spring for biasing the operation arm, and the cover does not cover the compression spring in the closed state.

5. The rebar tying tool according to claim 1, wherein:

the tying tool body further includes a main switch disposed in front of the reel supporting mechanism and laterally of the wire feeding mechanism, and the cover does not cover the main switch in the closed state.

6. The rebar tying tool according to claim 1, wherein:

the wire feeding mechanism includes a feeding motor, and the reel supporting mechanism is disposed rearward of the feeding motor and the twisting motor.

7. The rebar tying tool according to claim 6, wherein:

the tying tool body further includes:

a brake arm for stopping rotation of the reel; and a solenoid for activating the brake arm, and the solenoid is disposed between the feeding motor and the reel.

8. The rebar tying tool according to claim 1, wherein the reel supporting mechanism includes:

a fixed bearing, a position of the fixed bearing in a left-and-right direction being fixed with respect to the housing; and a bearing member disposed so as to face the fixed bearing, the bearing member being movable in the left-and-right direction with respect to the housing.

9. The rebar tying tool according to claim 1, wherein:

the wire feeding mechanism includes a feeding motor, the housing includes a right outer housing and a left outer housing, the feeding motor and the twisting motor are each disposed leftward of the right outer housing and rightward of the left outer housing, and the reel supporting mechanism is configured to support the reel such that the reel is disposed leftward of the right outer housing and rightward of the left outer housing.

10. The rebar tying tool according to claim 1, wherein the cover is configured to cover the upper side of the driving gear and the driven gear in the closed state.

* * * * *